US010760587B2

(12) United States Patent
Larosiliere et al.

(10) Patent No.: US 10,760,587 B2
(45) Date of Patent: Sep. 1, 2020

(54) EXTENDED SCULPTED TWISTED RETURN CHANNEL VANE ARRANGEMENT

(71) Applicant: Elliott Company, Jeannette, PA (US)

(72) Inventors: Louis M. Larosiliere, Greensburg, PA (US); Vishal Jariwala, Jeannette, PA (US)

(73) Assignee: Elliott Company, Jeannette, PA (US)

( * ) Notice: Subject to any disclaimer, the term of this patent is extended or adjusted under 35 U.S.C. 154(b) by 362 days.

(21) Appl. No.: 15/614,927

(22) Filed: Jun. 6, 2017

(65) Prior Publication Data

US 2018/0347584 A1 Dec. 6, 2018

(51) Int. Cl.

| | |
|---|---|
| ***F04D 29/44*** | (2006.01) |
| ***F04D 17/12*** | (2006.01) |
| ***F04D 29/28*** | (2006.01) |
| ***F04D 17/06*** | (2006.01) |

(52) U.S. Cl.

CPC ..... *F04D 29/444* (2013.01); *F04D 17/06* (2013.01); *F04D 17/122* (2013.01); *F04D 29/284* (2013.01)

(58) Field of Classification Search

CPC ..... F04D 17/122; F04D 1/06; F04D 29/448; F04D 29/444; F04D 29/44; F04D 29/441

USPC ..... 415/199.2–199.3

See application file for complete search history.

(56) References Cited

U.S. PATENT DOCUMENTS

| | | | | |
|---|---|---|---|---|
| 1,347,003 A | | 7/1920 | Baumann et al. | |
| 4,865,519 A | * | 9/1989 | Diankui | F04D 1/04 415/210.1 |
| 5,165,849 A | | 11/1992 | Nakagawa et al. | |
| 6,595,746 B1 | | 7/2003 | Goto et al. | |
| 7,448,852 B2 | * | 11/2008 | Abdelwahab | F04D 29/444 415/208.3 |
| 8,016,557 B2 | * | 9/2011 | Abdelwahab | F04D 29/444 415/208.3 |
| 8,157,517 B2 | * | 4/2012 | Feher | F04D 17/122 415/199.2 |

(Continued)

FOREIGN PATENT DOCUMENTS

| | | | | |
|---|---|---|---|---|
| EP | 1416123 A2 | * | 5/2004 | F01D 9/02 |
| GB | 604121 A | * | 6/1948 | F04D 29/44 |

(Continued)

OTHER PUBLICATIONS

Veress et al.; "Inverse Design and Optimization of a Return Channel for a Multistage Centrifugal Compressor"; Journal of Fluids Engineering; 2004; pp. 799-806; vol. 126.

*Primary Examiner* — Richard A Edgar
*Assistant Examiner* — Maranatha Boardman
(74) *Attorney, Agent, or Firm* — The Webb Law Firm

(57) ABSTRACT

A turbomachine including a housing having an inlet end opposite and outlet end along a longitudinal axis of the housing, a shaft assembly provided within the housing, the shaft assembly extending from the inlet end to the outlet end, a rotor having at least one rotating impeller extending radially outward from the shaft assembly, and a return channel vane hub extending radially outward from the shaft assembly, the return channel vane hub includes at least one return channel vane extend therefrom, the at least one return channel vane comprising a body having a leading edge and a trailing edge, the leading edge is twisted and extended past an outer edge of the return channel vane hub, and the trailing edge is bowed outwardly.

18 Claims, 24 Drawing Sheets

(56) References Cited

U.S. PATENT DOCUMENTS

| | | | | |
|---|---|---|---|---|
| 8,251,649 | B2 | 8/2012 | Goto et al. | |
| 8,511,981 | B2 * | 8/2013 | Small | F04D 29/444 415/148 |
| 8,602,728 | B2 | 12/2013 | Swiatek et al. | |
| 8,613,592 | B2 | 12/2013 | Gomez | |
| 9,222,485 | B2 * | 12/2015 | Brown | F04D 29/444 |
| 9,822,793 | B2 * | 11/2017 | Sezal | F04D 17/122 |
| 2005/0042083 | A1 | 2/2005 | MilBurn et al. | |
| 2005/0220616 | A1 | 10/2005 | Vogiatzis et al. | |
| 2007/0059169 | A1 | 3/2007 | Barnett et al. | |
| 2009/0226322 | A1 | 9/2009 | Clemen | |
| 2009/0297344 | A1 | 12/2009 | Hill et al. | |
| 2010/0021292 | A1 | 1/2010 | Maier et al. | |
| 2010/0272564 | A1 | 10/2010 | Richter et al. | |
| 2011/0194931 | A1 | 8/2011 | Swiatek et al. | |
| 2012/0121402 | A1 | 5/2012 | Brown et al. | |
| 2013/0302156 | A1 | 11/2013 | Nurzynski | |
| 2013/0309082 | A1 * | 11/2013 | Sugimura | F04D 29/444 415/211.2 |
| 2013/0315741 | A1 | 11/2013 | Small et al. | |
| 2014/0186173 | A1 * | 7/2014 | Blair | F04D 29/444 415/209.3 |
| 2014/0248144 | A1 | 9/2014 | Cellier et al. | |
| 2015/0086396 | A1 | 3/2015 | Nasir | |
| 2015/0300369 | A1 | 10/2015 | Sezal et al. | |
| 2016/0327056 | A1 | 11/2016 | Nakaniwa et al. | |
| 2020/0011345 | A1 | 1/2020 | Hermes | |

FOREIGN PATENT DOCUMENTS

| | | | | |
|---|---|---|---|---|
| GB | 884507 | A * | 12/1961 | F04D 29/441 |
| JP | 56002499 | A * | 1/1981 | F04D 1/06 |
| WO | WO-2017170640 | A1 * | 10/2017 | F04D 1/08 |

* cited by examiner

EXTENDED SCULPTED TWISTED RETURN CHANNEL VANE ARRANGEMENT

BACKGROUND OF THE INVENTION

Field of the Invention

The present disclosure generally relates to turbomachines and other fluid transport machinery and, more particularly, to vane arrangements for return channels within a turbomachine.

Description of Related Art

Turbomachines, such as centrifugal, axial, or mixed-flow compressors, pumps, fans, blowers, and turbines including hot gas expanders, are widely used throughout the energy industry worldwide. These machines interact with working fluid, which could be liquid or gas or multi-phase with single or multiple components to either provide energy to the fluid to increase its pressure or head, as in the case of compressors, or extract energy from a working fluid, as in the case of turbines (including expanders). These turbomachines find global and widespread applications in industries like ethylene production, refineries, process industries, air separation units, and power generation.

With reference to FIG. 1, a multi-stage, centrifugal-flow turbomachine 10, such as a compressor, is illustrated in accordance with a conventional design. In some applications, a single stage may be utilized. In each stage of the turbomachine 10, the fluid supplied to the turbomachine 10 is partially compressed and directed to the next stage, which further compresses the fluid. Using this arrangement, the fluid is compressed in stages through the turbomachine 10. Such turbomachine 10 generally includes a shaft 20 supported within a housing 30 by a pair of bearings 40. Turbomachine 10 shown in FIG. 1 includes a plurality of stages to progressively increase the fluid pressure of the working fluid. Each stage is successively arranged along the longitudinal axis of turbomachine 10 and all stages may or may not have similar components operating on the same or similar principle.

With continuing reference to FIG. 1, an impeller 50 includes a plurality of rotating blades 60 circumferentially arranged and attached to an impeller hub 70 which is in turn attached to shaft 20. Blades 60 may be optionally attached to a cover disk 65. A plurality of impellers 50 may be spaced apart in multiple stages along the axial length of shaft 20. Rotating blades 60 are fixedly coupled to impeller hub 70 such that rotating blades 60 along with impeller hub 70 rotate with the rotation of shaft 20. Rotating blades 60 rotate downstream of a plurality of stationary vanes or stators 80 attached to a stationary tubular casing. The working fluid, such as a gas mixture, generally enters and exits turbomachine 10 in a perpendicular direction relative to the shaft 20. Energy from the working fluid causes a relative motion of rotating blades 60 with respect to stators 80. In a centrifugal compressor, the cross-sectional area between rotating blades 60 within impeller 50 decreases from an inlet end to a discharge end along the axis of rotation, such that the working fluid is compressed as it passes across impeller 50.

Referring to FIG. 2, working fluid, such as a gas mixture, moves from an inlet end 90 to an outlet end 100 of turbomachine 10. A row of stators 80 provided at inlet end 90 channels the working fluid into a row of rotating blades 60. Stators 80 extend within the casing for channeling the working fluid to rotating blades 60. Stators 80 are spaced apart circumferentially with equal spacing between individual struts around the perimeter of the casing. A diffuser 110 is provided at the outlet of rotating blades 60 for guiding the fluid flow coming off rotating blades 60, while diffusing the flow, i.e., converting kinetic energy into static pressure rise. Diffuser 110 optionally has a plurality of diffuser vanes 120 extending within a casing. Diffuser blades 120 are spaced apart circumferentially typically with equal spacing between individual diffuser blades 120 around the perimeter of the diffuser casing. In a multi-stage turbomachine 10, a plurality of return channel vanes 125 are provided at outlet end 100 of a fluid compression stage for channeling the working fluid to rotating blades 60 of the next successive stage. In such an embodiment, the return channel vanes 125 provide the function of stators 80 from the first stage of turbomachine 10. The last impeller in a multi-stage turbomachine typically only has a diffuser, which may be provided with or without the diffuser vanes. The last diffuser channels the flow of working fluid to a discharge casing (volute) having an exit flange for connecting to the discharge pipe. In a single-stage embodiment, turbomachine 10 includes stators 80 at inlet end 90 and diffuser 110 at outlet end 100. In another embodiment of the single-stage embodiment, the return channel vanes 125 may also be provided.

Due to recent market demands for turbomachines that are capable of efficiently handling higher flow rates combined with reduced stage size, a high flow coefficient stage has been developed. Current designs include a 3D mixed-flow shrouded impeller aerodynamically matched with a low vane count (~12) return channel. It has been discovered that the residual swirl angle and its spanwise variance at the stage exit are higher than desired for a multi-stage application. The higher the levels of residual swirl at the exit of the stage the greater the chance the swirl can compromise the overall head rise in a downstream impeller, which may not have been specifically designed to accommodate the increased swirl. In addition, the spanwise variance of the swirl angle can have an impact on the useable operating range of the downstream stage. A counter-rotating swirling flow near the shroud 65 at the return channel exit can adversely impact the aerodynamic stability of a downstream impeller. For high flow coefficient stages, return channels can be responsible for a large portion of overall stage inefficiency.

SUMMARY OF THE INVENTION

In view of the foregoing deficiencies, it is an object of this disclosure to achieve a useful reduction in the return channel exit residual average swirl angle and its spanwise variance. It is another object of this disclosure to maintain or improve the total pressure loss characteristics of the return channel system, while adhering to stage spacing and mechanical design constraints. In one example of the present disclosure, stage spacing is understood to be a distance between the diffuser hub of a given stage of the turbomachine to the same diffuser hub location on the previous stage.

In one example of the disclosure, a return channel vane for a return channel hub of a turbomachine including a body including a leading edge and a trailing edge provided on an opposite end of the body, wherein the leading edge is twisted relative to a meridional line of the body, and wherein the trailing edge is bowed outwardly relative to the meridional line of the body.

In another example of the disclosure, the return channel vane is comprised of at least three sections stacked on top of one another when viewed along a longitudinal axis of the return channel vane. At least two sections of the return channel vane have a leading edge with different blade angles relative to the meridional line of the body. At least two sections of the return channel vane have a trailing edge with different blade angles relative to the meridional line of the body. The trailing edge of one of the at least two sections is angled to one side of the meridional line of the body and the trailing edge of the other of the at least two sections is angled to an opposing side of the meridional line of the body. The blade angles range between +10° and −20° relative to the meridional line of the body. A leading edge of at least one section of the return channel vane extends further from the body than leading edges of the remaining sections of the return channel vane. A trailing edge of at least one section of the return channel vane extends further from the body than trailing edges of the remaining sections of the return channel vane. Each section has a curvature relative to a longitudinal axis of the return channel vane. The curvature of at least one section is different from the curvature of the remaining sections. The body of the return channel vane is curved relative to a longitudinal axis of the return channel vane.

In one example of the disclosure, a turbomachine including a housing having an inlet end opposite and outlet end along a longitudinal axis of the housing, a shaft assembly provided within the housing, the shaft assembly extending from the inlet end to the outlet end, a rotor having at least one impeller extending radially outward from the shaft assembly, and a return channel vane hub extending radially outward from the shaft assembly, the return channel vane hub includes at least one return channel vane extend therefrom, the at least one return channel vane comprising a body having a leading edge and a trailing edge, the leading edge is twisted and extended past an outer edge of the return channel vane hub, and the trailing edge is bowed outwardly.

In another example of the disclosure, the at least one return channel vane is comprised of at least three sections stacked on top of one another when viewed along a longitudinal axis of the return channel vane. At least two sections of the at least one return channel vane have a leading edge with different blade angles relative to the meridional line of the body. At least two sections of the at least one return channel vane have a trailing edge with different blade angles relative to the meridional line of the body. The trailing edge of one of the at least two sections is angled to one side of the meridional line of the body and the trailing edge of the other of the at least two sections is angled to an opposing side of the meridional line of the body. The blade angles range between +10° and −20° relative to the meridional line of the body. A leading edge of at least one section of the at least one return channel vane extends further from the body than leading edges of the remaining sections of the at least one return channel vane. A trailing edge of at least one section of the at least one return channel vane extends further from the body than trailing edges of the remaining sections of the at least one return channel vane. Each section has a curvature relative to a longitudinal axis of the at least one return channel vane. The curvature of at least one section is different from the curvature of the remaining sections. The body of the at least one return channel vane is curved relative to a longitudinal axis of the at least one return channel vane.

These and other features and characteristics of the turbomachine, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

FIG. 3(*b*) is a perspective cross-sectional view of the turbomachine of FIG. 3(*a*);

FIG. 3(*c*) is a cross-sectional view of the turbomachine of FIG. 3(*a*);

FIG. 4(*b*) is a rear view of the return channel hub of FIG. 4(*a*);

FIG. 4(*c*) is a side view of the return channel hub of FIG. 4(*a*);

FIG. 4(*d*) is a cross-sectional view of the return channel hub of FIG. 4(*a*);

FIG. 5(*b*) is a perspective view of the return channel vane of FIG. 5(*a*);

FIG. 5(*c*) is another perspective view of the return channel vane of FIG. 5(*a*);

FIG. 5(*d*) is another perspective view of the return channel vane of FIG. 5(*a*);

FIG. 5(*e*) is another perspective view of the return channel vane of FIG. 5(*a*);

FIG. 6(*b*) is a meridional view of a return channel vane having an extended leading edge according to the present disclosure;

FIG. 6(*c*) is a meridional view of a return channel vane having an extended trailing edge according to the present disclosure;

DESCRIPTION OF THE DISCLOSURE

Figure 1:
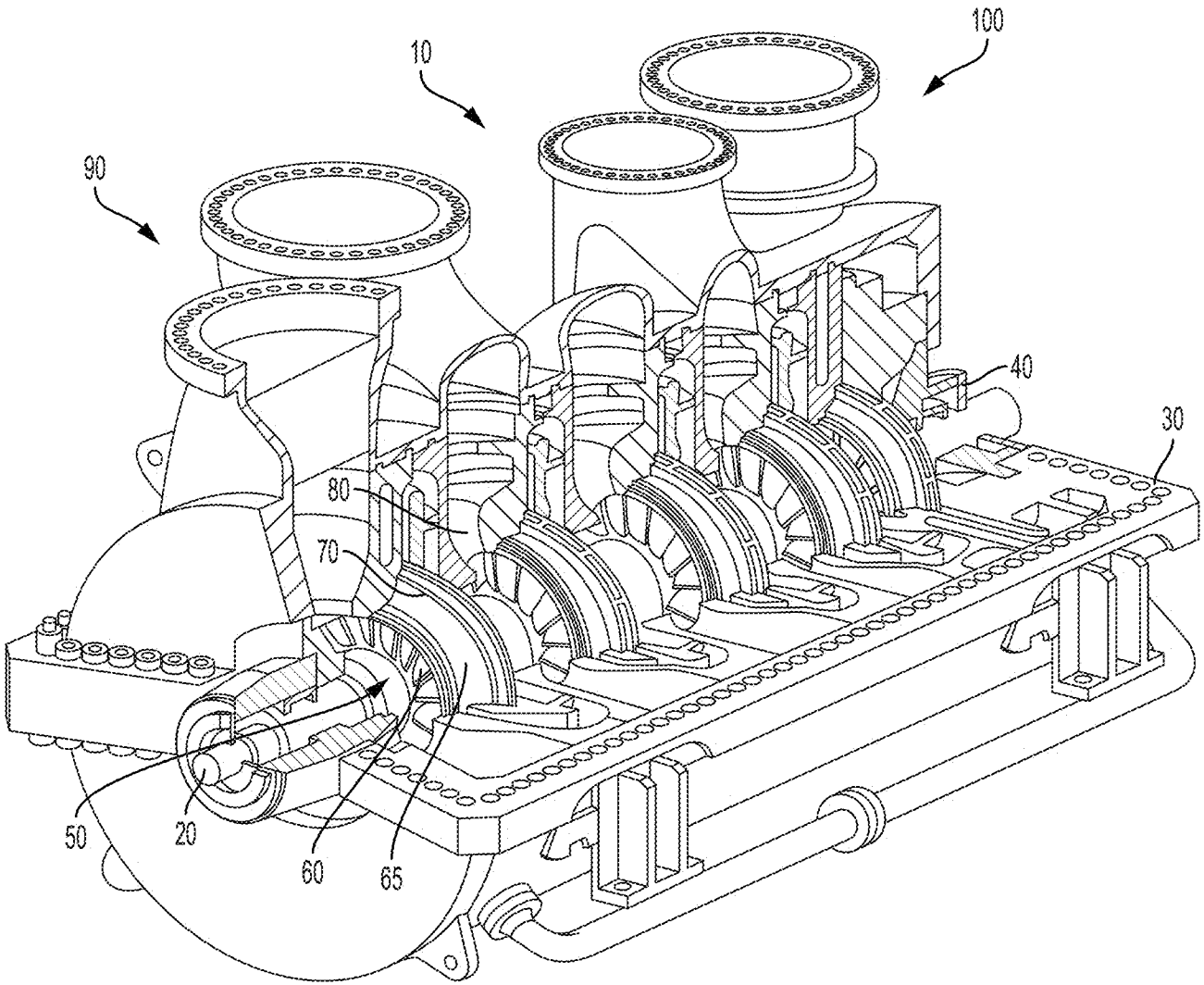
FIG. 1 PRIOR ART
FIG. 1 is a perspective view of a turbomachine according to the prior art.
Figure 2:
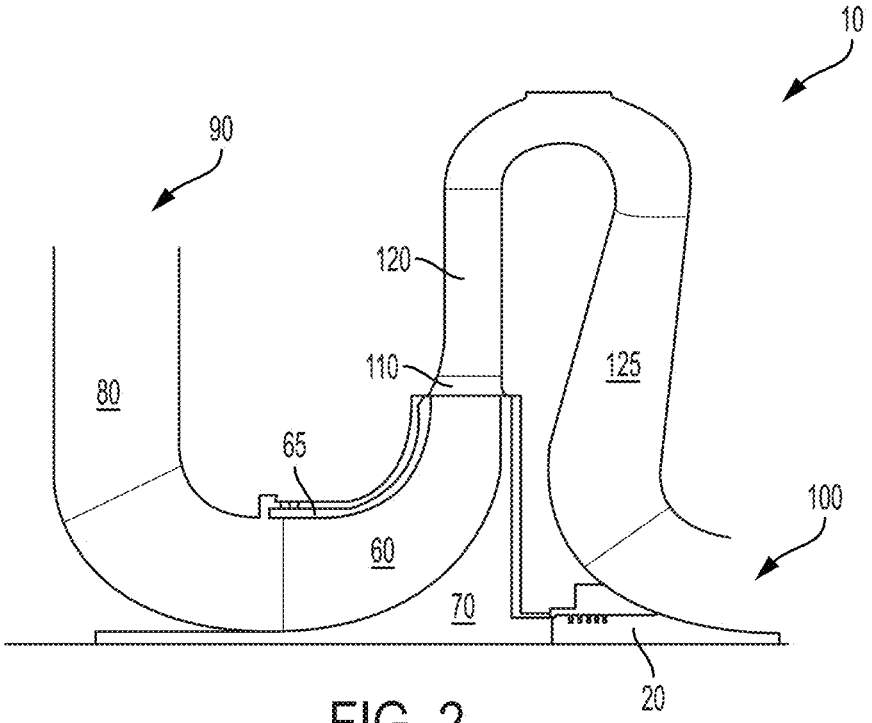
FIG. 2 PRIOR ART
FIG. 2 is a schematic cross-sectional view of one stage of the turbomachine shown in FIG. 1.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Figure 3A:
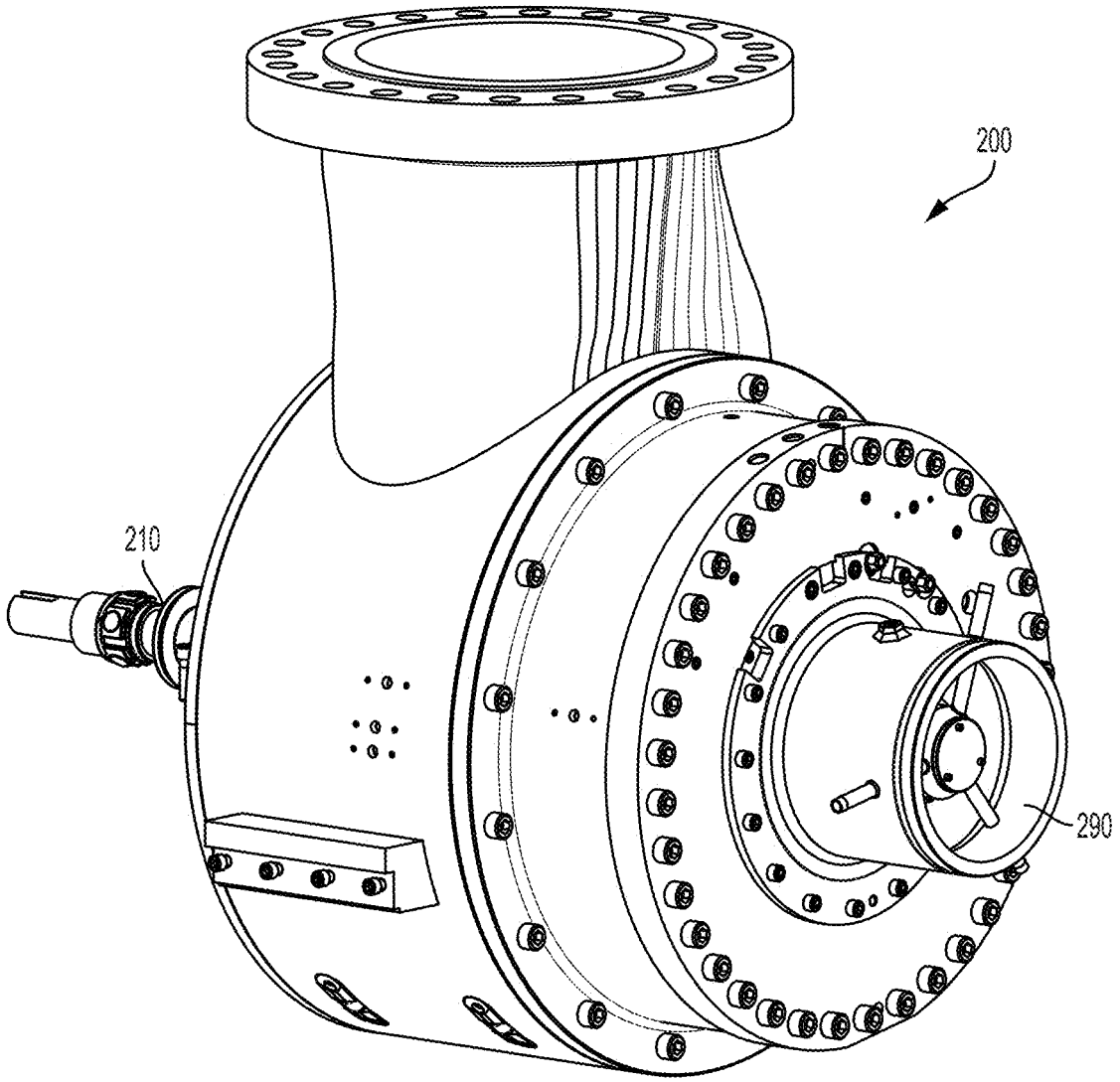
FIG. 3(*a*) is a perspective view of a turbomachine according to one example of the present disclosure.
Figure 3B:
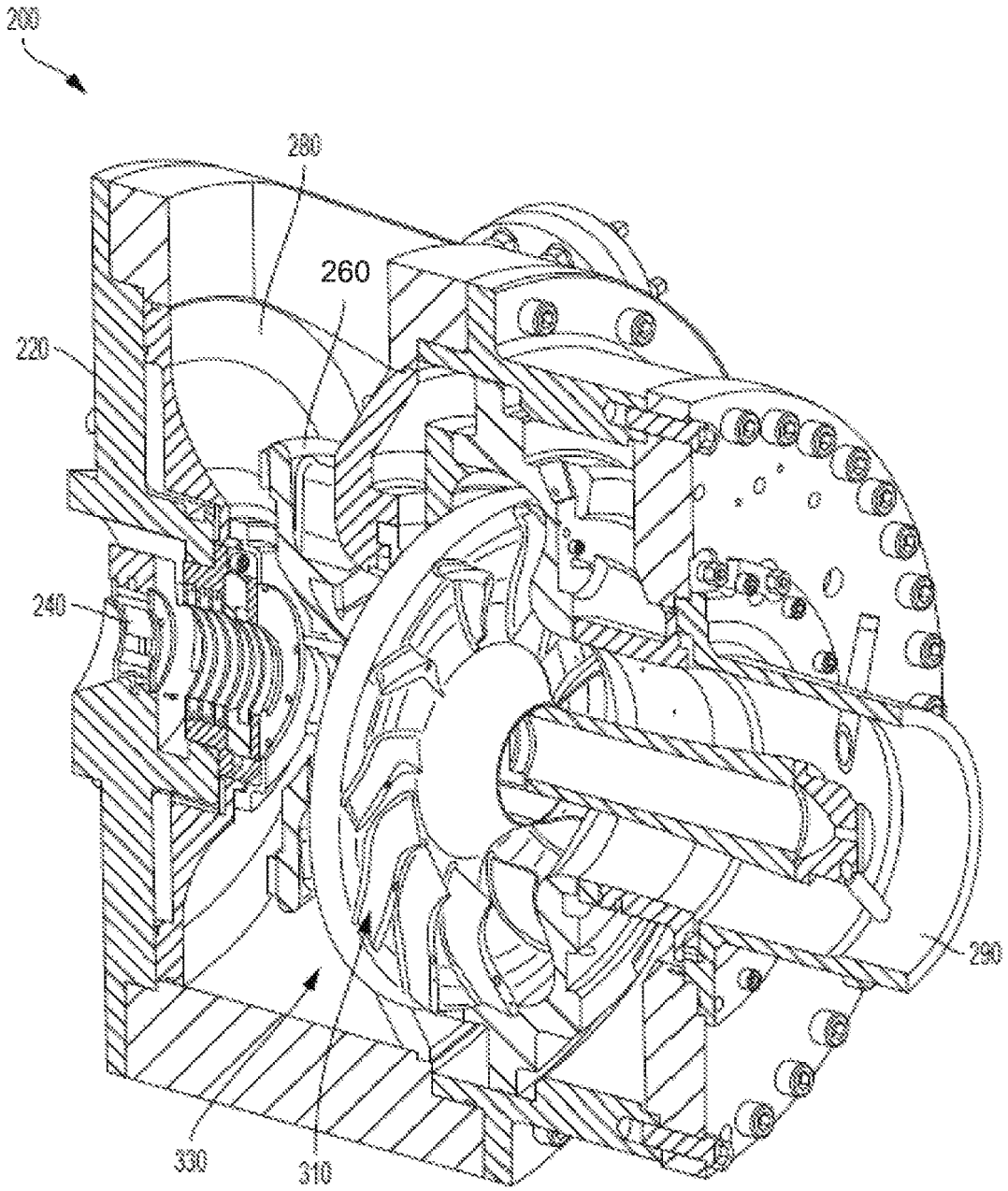
Figure 3C:
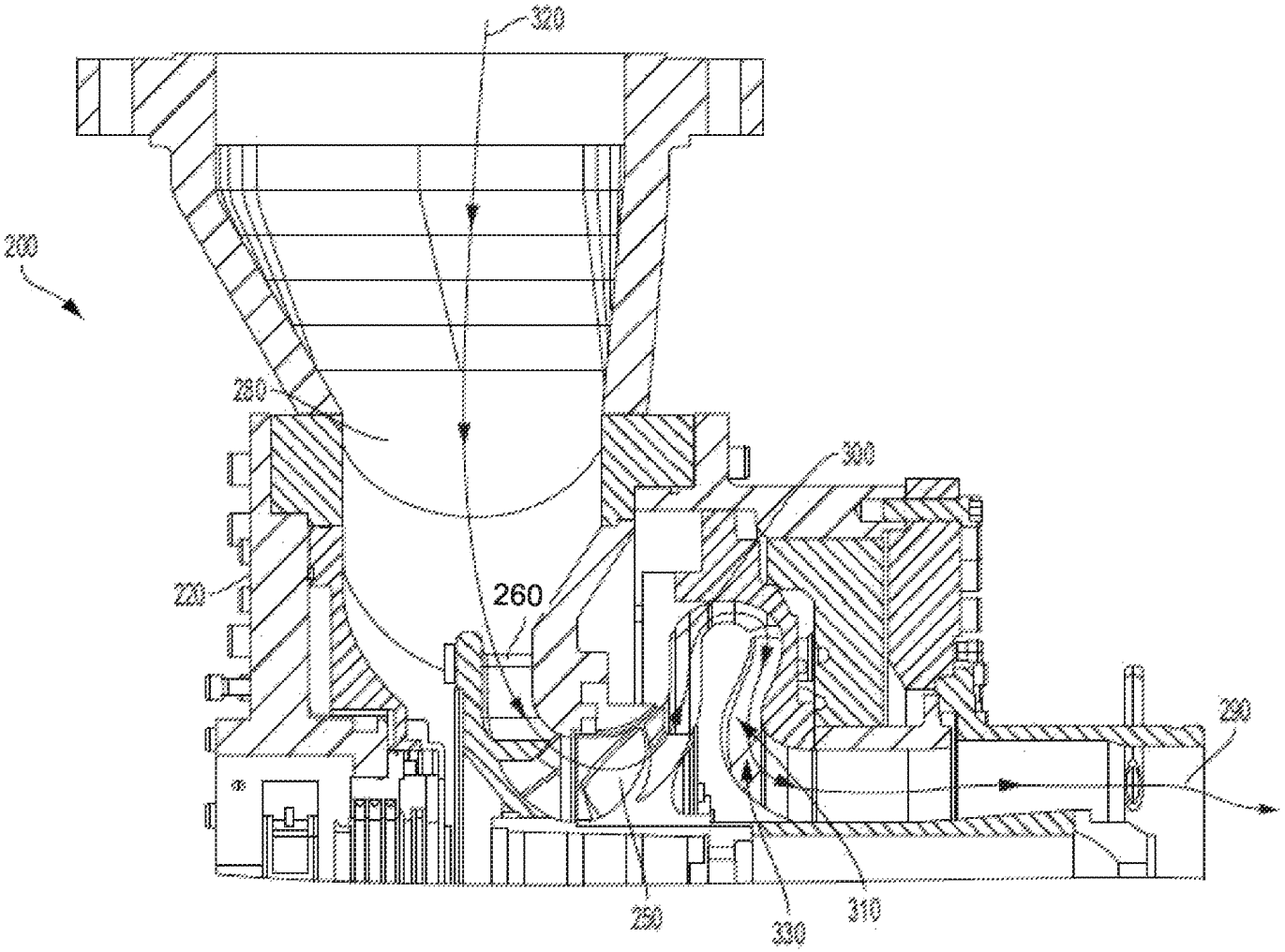
Figure 4A:
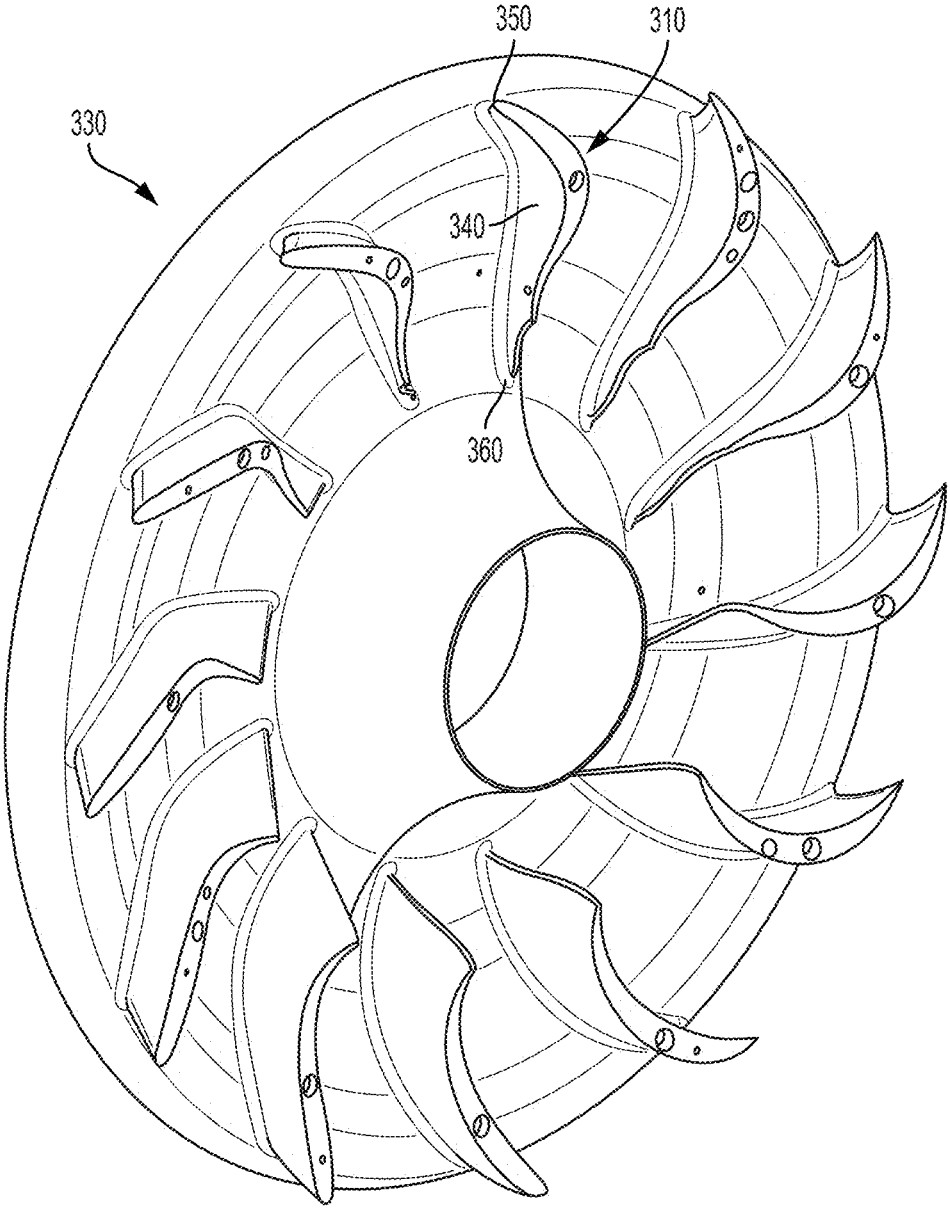
FIG. 4(*a*) is perspective view of a return channel hub according to one example of the present disclosure.
Figure 4B:
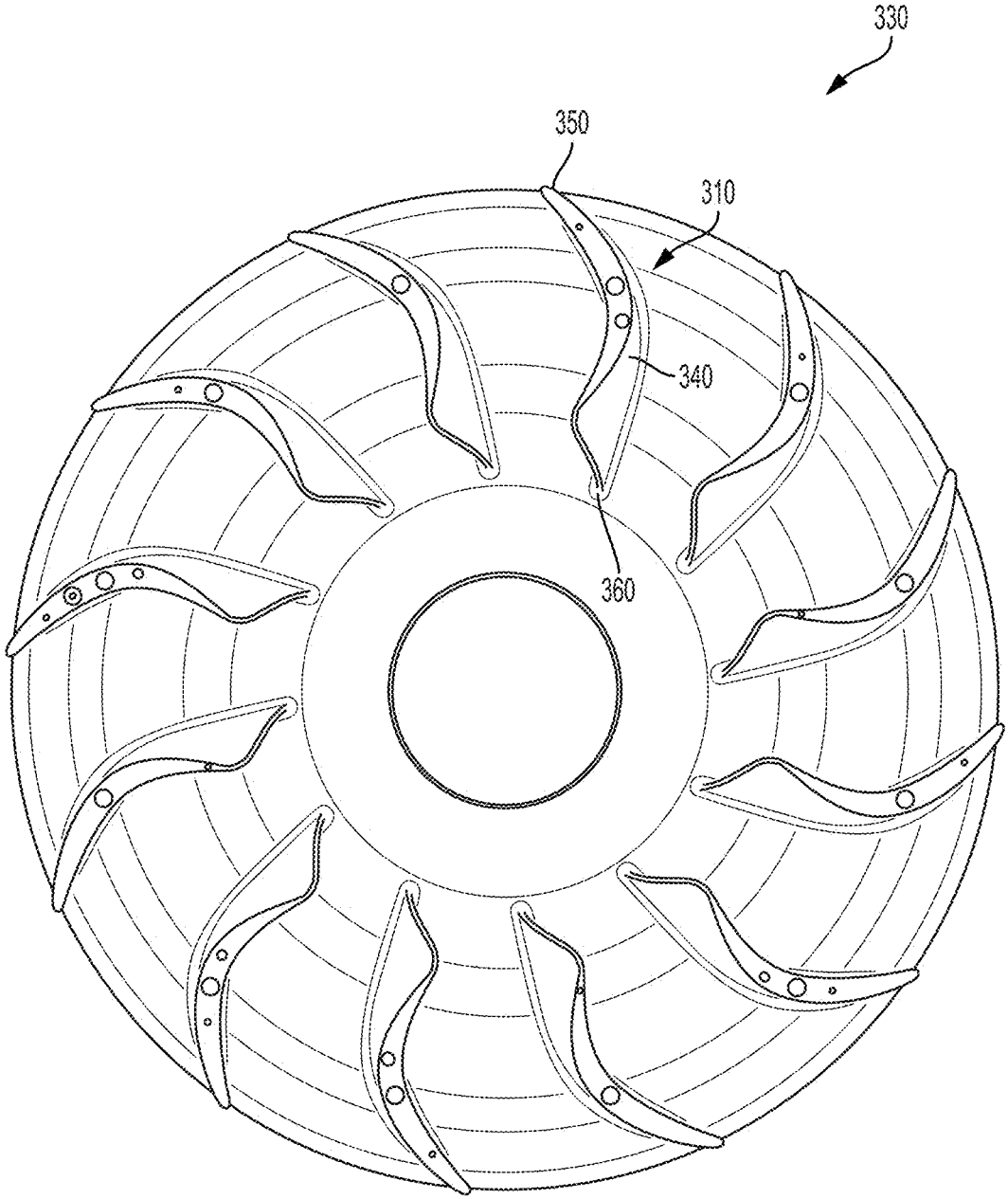
Figure 4C:
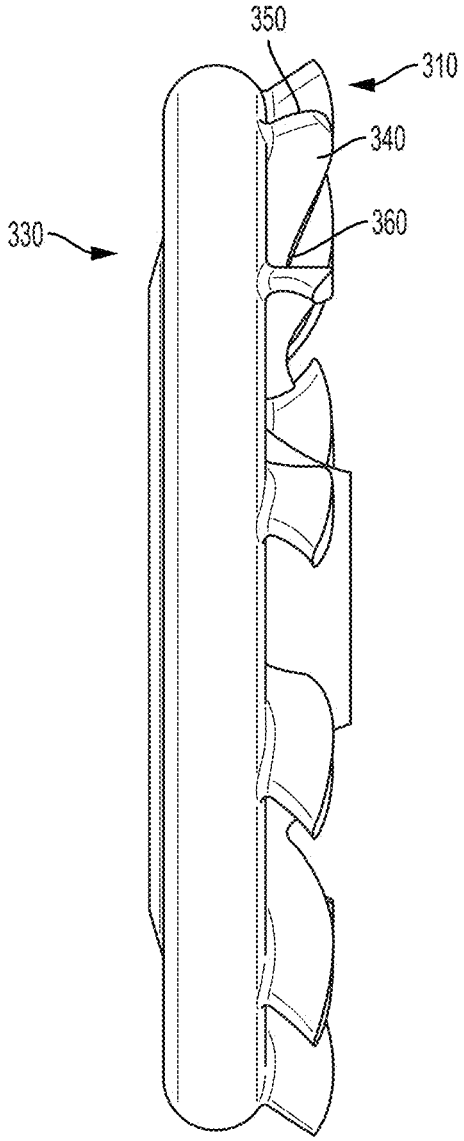
Figure 4D:
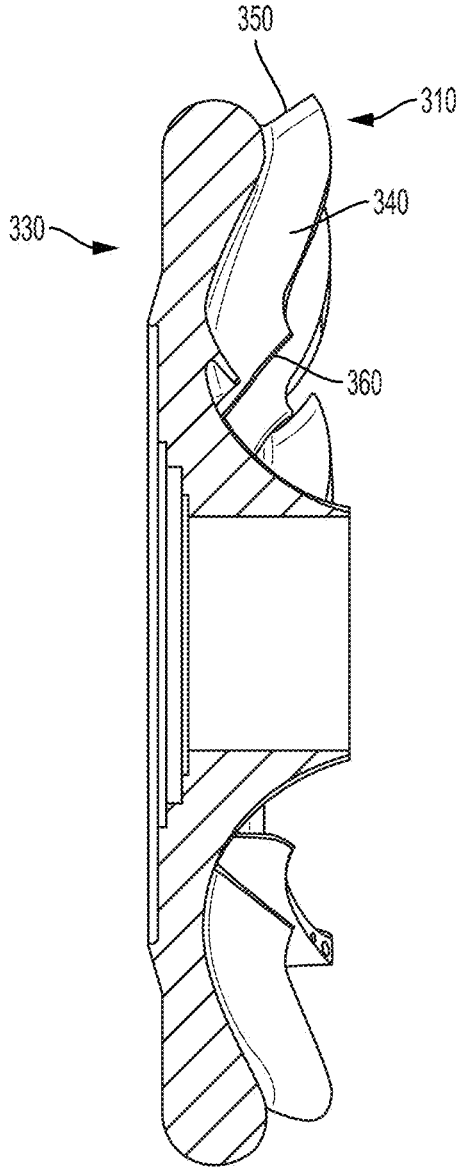
Figure 5A:
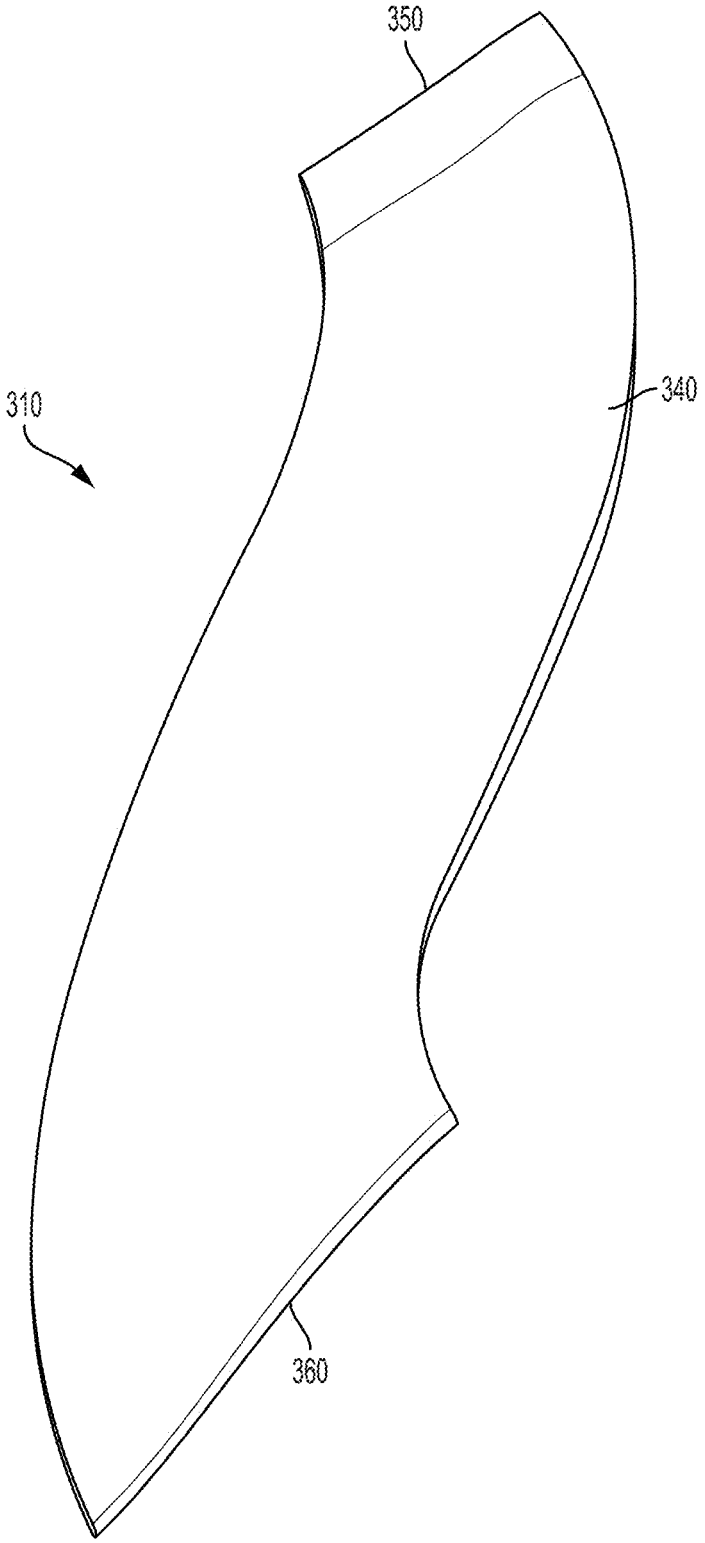
FIG. 5(*a*) is a side view of a return channel vane according to one aspect of the present disclosure.
Figure 5B:
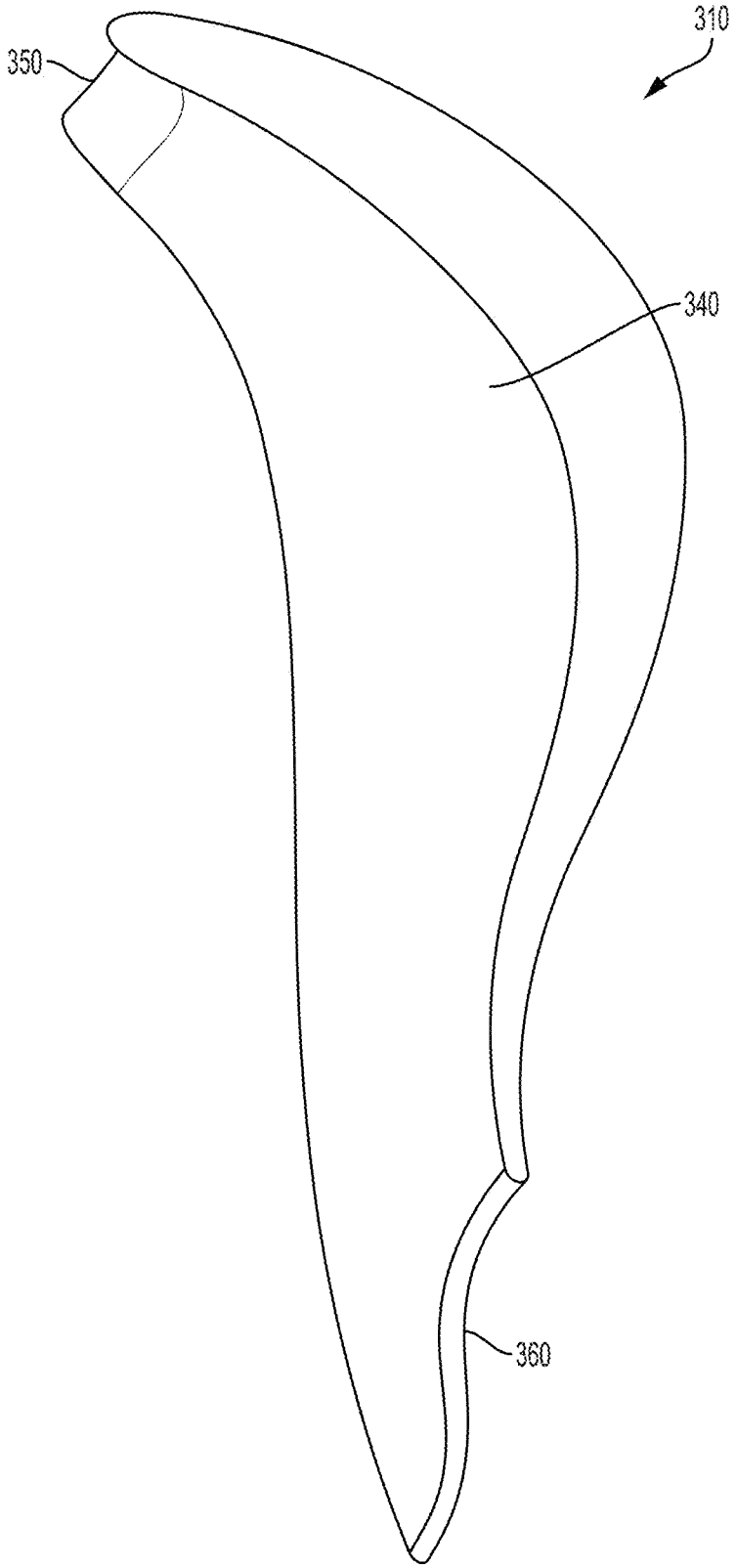
Figure 5C:
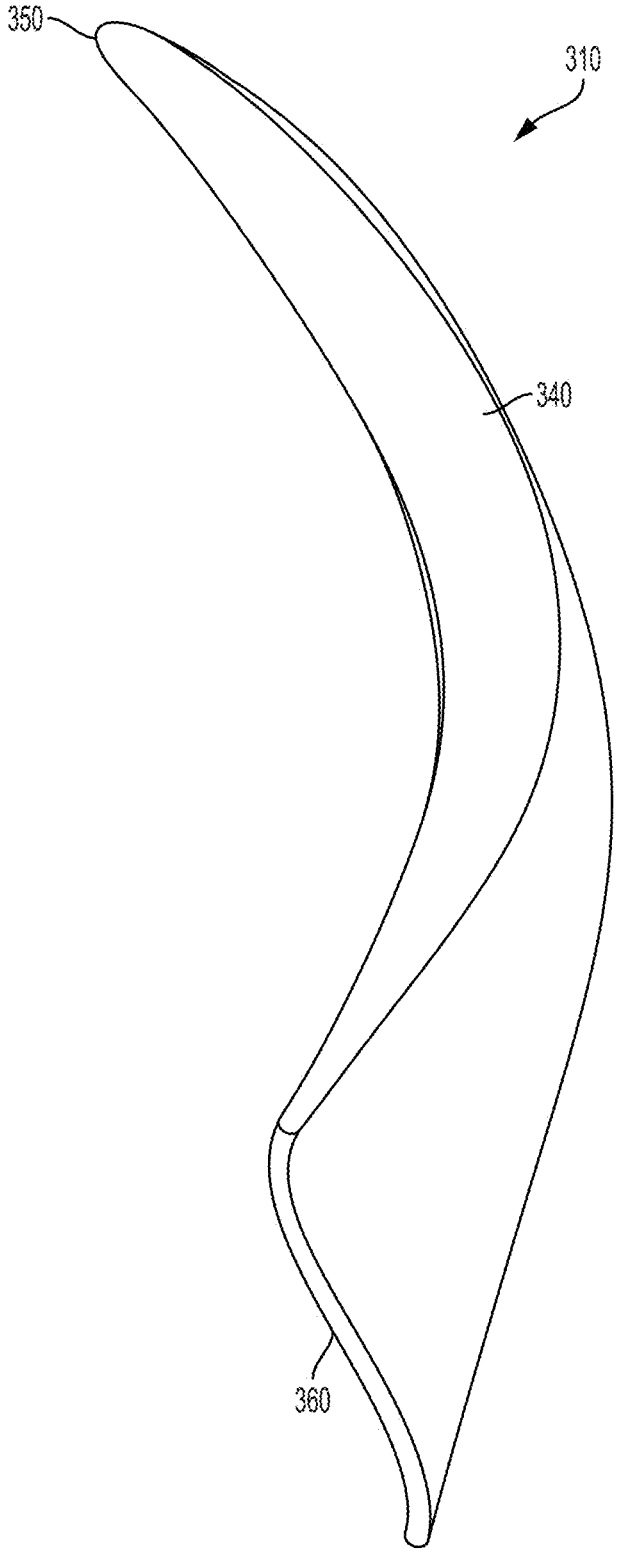
Figure 5D:
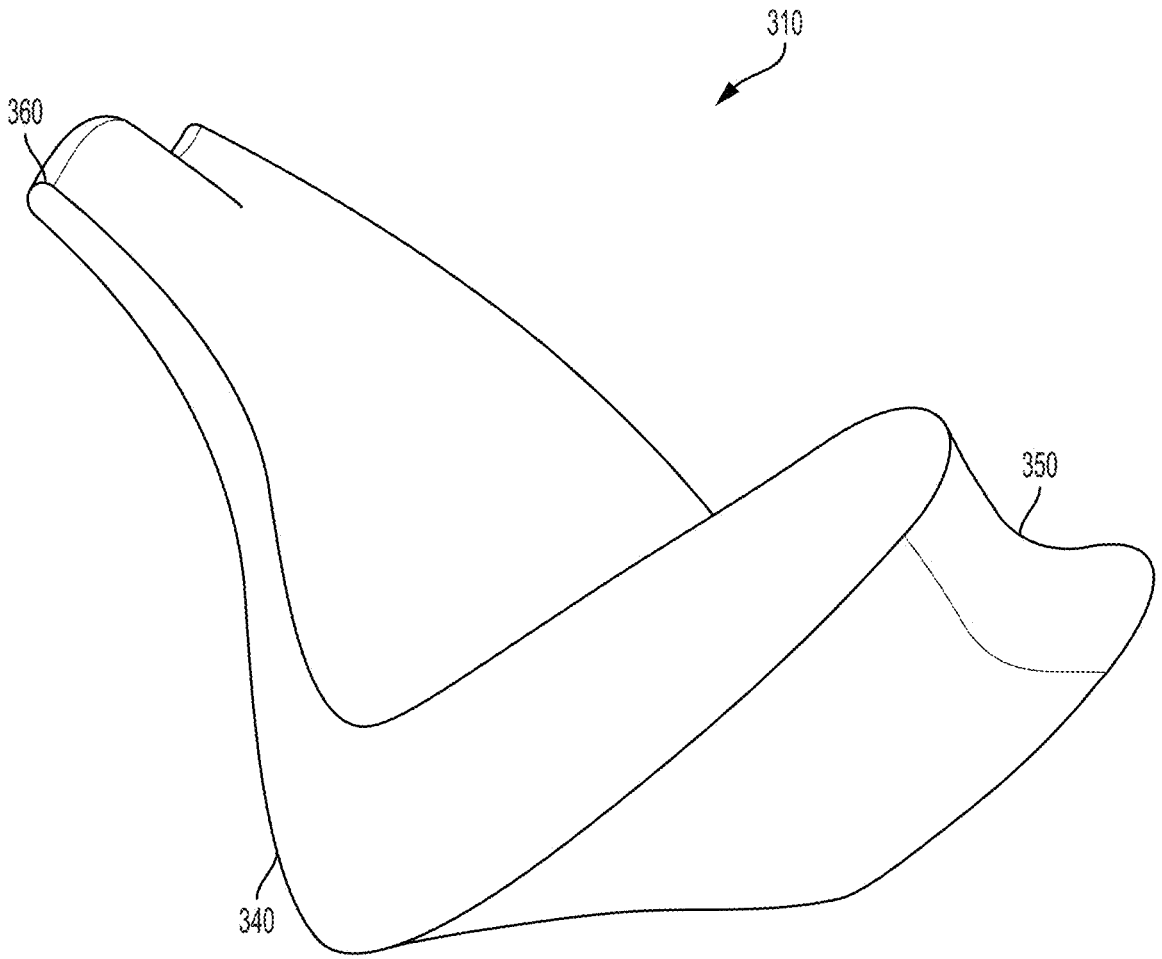
Figure 5E:
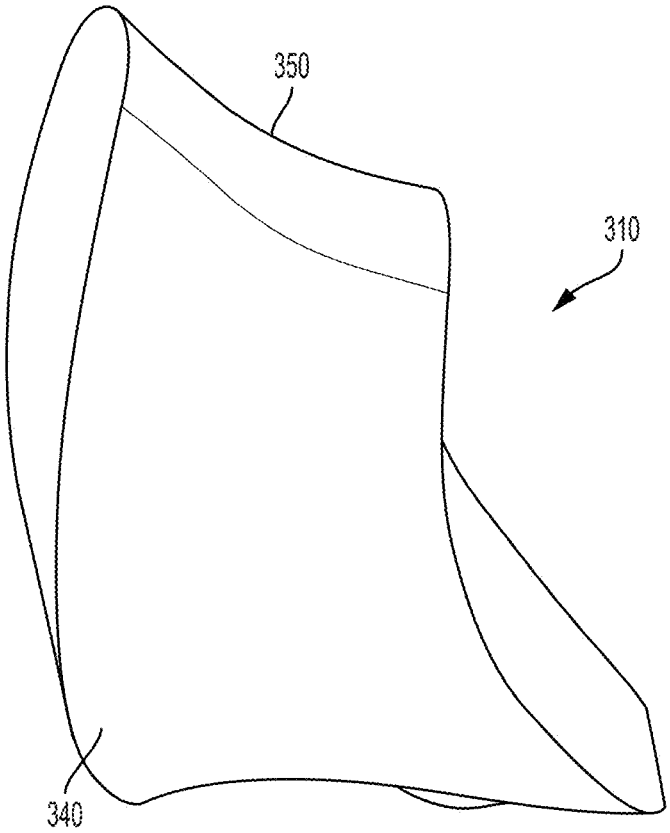

With reference to FIGS. 3(*a*)-3(*c*), a turbomachine 200 according to one example of the present disclosure is shown. In one example, the turbomachine 200 is a multi-stage, centrifugal-flow turbomachine. In some applications, a single stage may be utilized. Such turbomachine 200 generally includes a shaft 210 supported within a housing 220 by a pair of bearings. Turbomachine 200 shown in FIG. 3(*a*) may include a plurality of stages to progressively increase the fluid pressure of the working fluid. Each stage is successively arranged along the longitudinal axis of turbomachine 200 and all stages may or may not have similar components operating on the same or similar principle. In one aspect, the turbomachine 200 has a high flow coefficient compressor stage. In one example, the impeller 240 has a design $\phi$ of 0.237. In another aspect, the impeller 240 has a design $\phi$ of 0.18-0.28. It is also contemplated the present disclosure can be used with the turbomachine 10 of FIG. 1.

With continuing reference to FIGS. 3(*a*)-3(*c*), an impeller 240 includes a plurality of rotating blades 250 circumferentially arranged and attached to an impeller hub 260 which is in turn attached to the shaft 210. The blades 250 may be optionally attached to a cover disk. A plurality of impellers 240 may be spaced apart in multiple stages along the axial length of shaft 210. The rotating blades 250 are fixedly coupled to impeller hub 260 such that the rotating blades 250, along with the impeller hub 260, rotate with the rotation of the shaft 210. The rotating blades 250 rotate downstream of a plurality of stationary vanes or stators 270 attached to a stationary tubular casing. The working fluid, such as a gas mixture, enters and exits turbomachine 200 in the axial direction of shaft 210. The rotating blades 250 are rotated using an external energy source, such as a motor. The rotating blades 250 in turn work on the fluid to compress the fluid and increase its energy content. The rotating blades 250 are attached to both the impeller hub 260 and an impeller shroud. The rotating blades 250 rotate with reference to stator 270 and return channel vanes 330 (described below). In a centrifugal compressor, the cross-sectional area between the rotating blades 250 within the impeller 240 decreases from an inlet end to a discharge end, such that the working fluid is compressed as it passes across impeller 240.

The working fluid, such as a gas mixture, moves from an inlet end 280 to an outlet end 290 of the turbomachine 200. A row of stators 270 provided at the inlet end 280 channels the working fluid into a row of the rotating blades 250. The stators 270 extend within the casing for channeling the working fluid to the rotating blades 250. The stators 270 are spaced apart circumferentially with equal spacing between individual struts around the perimeter of the casing. A diffuser 300 is provided at the outlet of the rotating blades 250 for guiding the fluid flow coming off the rotating blades 250, while diffusing the flow, i.e., converting kinetic energy into static pressure rise. The diffuser 300 optionally has a plurality of diffuser vanes extending within a casing. In one example, the diffuser blades are spaced apart circumferentially typically with equal spacing between individual diffuser blades around the perimeter of the diffuser casing. In a multi-stage turbomachine 200, a plurality of return channel vanes 310 are provided at in the flow path after the fluid compression phase for channeling the working fluid to the rotating blades 250 of the next successive stage. In such an embodiment, the return channel vanes 310 provide the function of stators from the first stage of turbomachine 200. The last impeller in a multi-stage turbomachine typically only has a diffuser, which may be provided with or without the diffuser vanes. The last diffuser channels the flow of working fluid to a discharge casing (volute) having an exit flange for connecting to the discharge pipe. In one example of a single-stage embodiment, the turbomachine 200 includes stators 270 at the inlet end 280 and the diffuser 300 at the outlet end 290. The working fluid flows along a flow path 320 through the turbomachine 200 such that the working fluid is compressed from the inlet end 280 to the outlet end 290 of the turbomachine 200.

Figure 15:
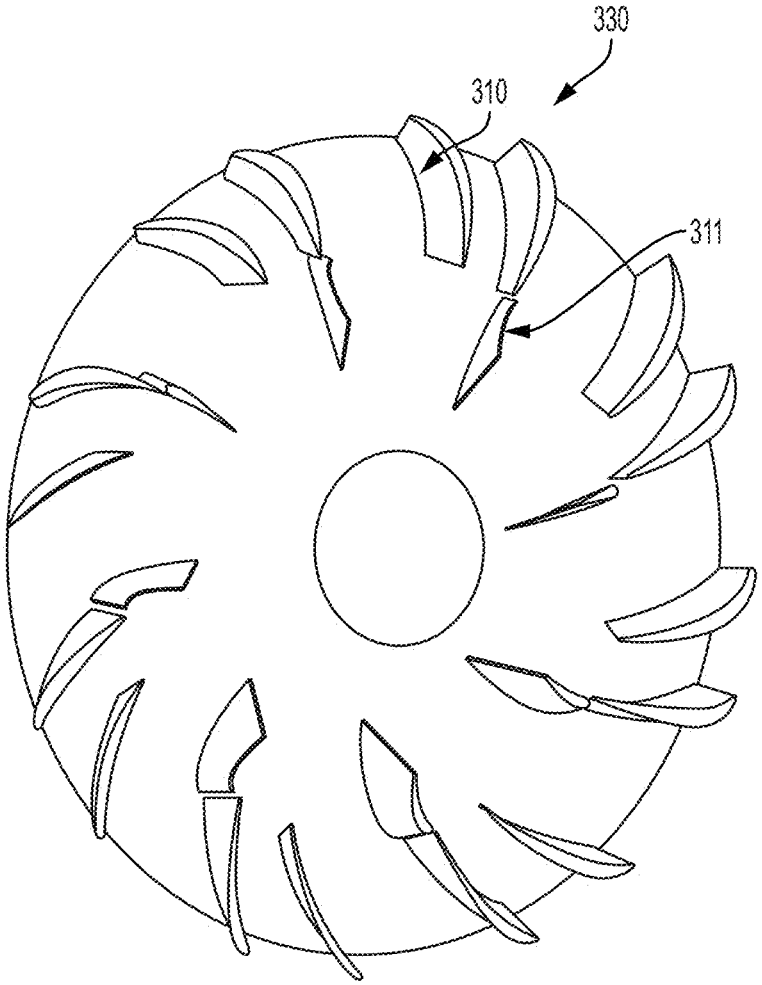
FIG. 15 is a perspective view of a return hub including multiple rows of return channel vanes according to another example of the present disclosure.

With reference to FIGS. 4(*a*)-4(*d*), a return channel vane hub 330 (hereinafter referred to as "return hub 330") is described. In one example, the return hub 330 is held stationary with reference to the shaft 210. The return hub 330 includes a plurality of return channel vanes 310 that extend therefrom. In one example, shown in FIG. 15, multiple rows of return channel vanes may be provided on the return hub 330. In one example, a first row of return channel vanes 310 according to the present disclosure may be provided and a second row of conventional return channel vanes 311 may be provided. In another example, two rows of return channel vanes 310 according to the present disclosure can be provided. The rows of return channel vanes 310 may extend radially from the center of the return hub 330. The return channel vanes 310 extend perpendicular to the return hub 330 towards the outlet end 290 of the turbomachine 200 to deflect the flow of the working fluid through the return channel. The return channel vanes 310 may be fastened to the return hub 330. In another example, the return channel vanes 310 are formed integral with the return hub 330. In one example, the plurality of return channel vanes 310 are spread at equal distances around the center of the return hub 330. For example, a plurality of twelve (12) return channel vanes 310 are spaced apart from one another. In another example, 16-24 return channel vanes 310 are spaced apart from one another. In another example, the return channel vanes 310 are spaced at predetermined varied distances from one another to minimize the average exit bulk swirl from the return channel. Each return channel vane 310 includes a body 340 with a leading edge 350 and a trailing edge 360. In one example, the leading edge 350 should be understood to be the edge of the body 340 provided on an outer portion of the return hub 330 or the portion of the body 340 that first comes in contact with the fluid. In one example, the trailing edge 360 is understood to be the edge of the body 340 provided on an inner portion of the return hub 330 or the portion of the body 340 where the body 340 ends in the stage and is farthest from the leading edge 350 along the general direction of the flow. The leading edge 350 is provided further from a center axis of the return hub 330 than is the trailing edge 360. Optimal results for the use of these return channel vanes 310 are in applications with a reduced vane count and high flow coefficients. It is contemplated, however, that these return channel vanes 310 can be used in any type of application.

Figure 11:
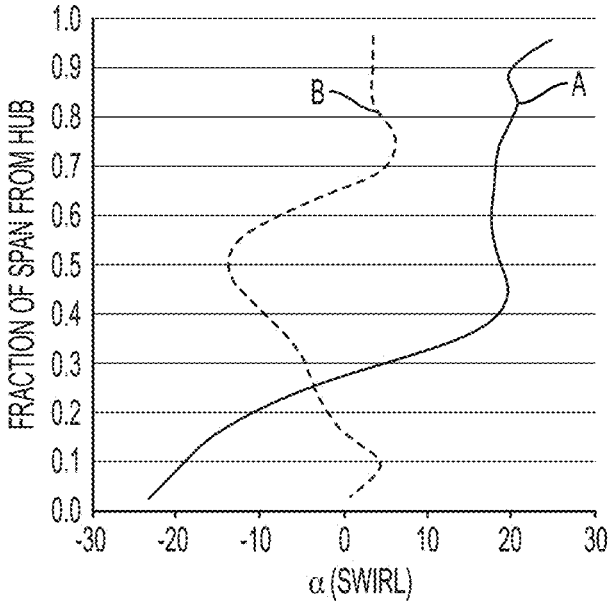
FIG. 11 is a graphical representation of spanwise swirl distribution of a return channel vane according to the prior art and a return channel vane according to one aspect of the present disclosure.

With reference to FIGS. 5(*a*)-5(*e*), the return channel vanes 310 are described in detail. These forms of return channel vanes 310 differ from conventional return channel vanes. The conventional return channel vanes have a constant cross section vane shape, which is extruded span-wise from the return hub 330 to a shroud of the flow path. The disclosed return channel vanes 310 assist in controlling aerodynamic loading and local flow structure, thereby resulting in a more uniform exit swirl angle distribution, as well as a low level average exit bulk swirl from the return channel. As shown in FIG. 11, the curve A corresponds to an extruded vane according to the prior art. The curve A shows a swirl angle that varies from −24° to +24°. The curve B corresponds to a return channel vane 310 according to the present disclosure. The curve B shows a reduced swirl angle that varies from −14° to +5°. The zero (0) position on the Y-axis of FIG. 11 corresponds to the hub location and the 1.0 position on the Y-axis corresponds to the shroud location. Using the arrangement of the return channel vanes 310 described in the present disclosure provides low bulk residual swirl angle with a small or no increase of total pressure losses for a relatively lower vane count. The form of these return channel vanes 310 can be adjusted based on 3D computational fluid dynamics simulations that take into account specific operating parameters of the turbomachine 200. The return channel vanes 310 provide a higher quality conveyance of flow between stages of the turbomachine 200. In the example shown in FIG. 5(*a*), the return channel vane 310 includes an extruded shape in the body 340 of the return channel vane 310. In one example, the body 340 is bent at its center to create a U-shape. It is also contemplated that the body 340 may be extruded into other shapes.

Figure 10:
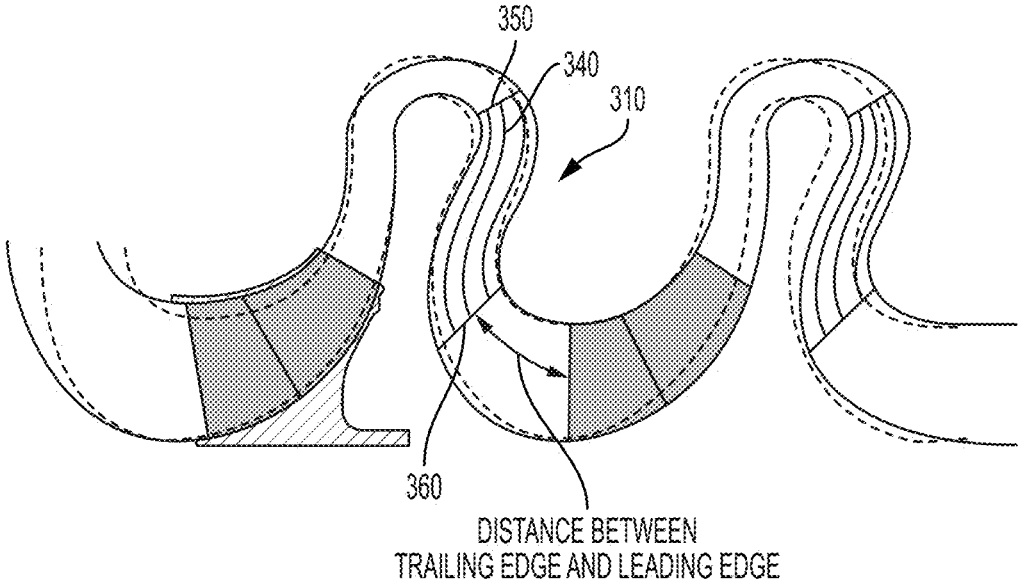
FIG. 10 is a schematic illustration of the different stages of a turbomachine according to one aspect of the present disclosure.

An increased vane passing frequency margin from a downstream impeller resonant frequency is also achieved using the arrangement of the return channel vanes 310 of the present disclosure. The increased vane passing frequency margin reduces the risk of high cycle fatigue in which a component fails due to extended usage. In a multi-stage arrangement, as shown in FIG. 10, as the leading edges of the downstream impeller rotate around the rotational axis of the turbomachine 100, the leading edges of the impeller pass the stationary trailing edge 360 of the return channel vanes 310 of the upstream stage. Using the present return channel vanes 310 allows for use of less return channel vanes (i.e., fewer number of trailing edges). By using a lower number of return channel vanes 310, the vane passing frequency margin is increased.

Figure 12:
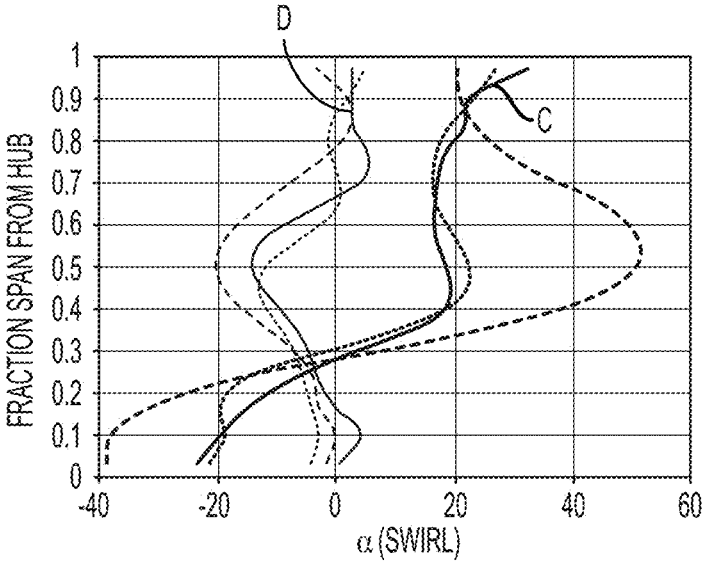
FIG. 12 is another graphical representation of spanwise swirl distribution of a return channel vane according to the prior art and a return channel vane according to one aspect of the present disclosure.

An improved design-point and off-design point aerodynamic matching with a downstream impeller is achieved with the present disclosure. This improved aerodynamic matching leads to higher overall multistage compressor performance and operating range. With reference to FIG. 12, curve C denotes a conventional extruded return channel vane and curve D corresponds to a return channel vane 310 according to the present disclosure. The various line types of the curves C, D represent flow conditions (solid line=nominal (i.e., design flow), dashed line=lower than nominal, and dotted line=higher than nominal). The dashed line and the dotted line represent off-design or unintended flow conditions. The curve C has a high variation as it moves spanwise from 0 to 1 on the graph, while the curve D does not vary as much. At a lower than nominal flow, the curve D continues providing a uniform distribution of swirl, while the curve C is much more non-uniform. This condition is also experienced with flow that is higher than nominal. Since the curve D does not vary as much at off-design conditions, the downstream stage will continue to receive uniform flow and its performance will remain consistent as the flow is varied during compressor operation. Thus, an improved matching between any given stage with the return channel vane arrangement of the present disclosure and the downstream stage. The given stage with the return channel vane arrangement provides flow that matches well with the conditions that will provide optimum aerodynamic performance. The present return channel vane arrangement provides reduced aeromechanics stimulus on a downstream impeller, which reduces high cycle fatigue risk for components of the compressor. The non-uniformity in the flow exiting a return channel can act as a stimulus for a downstream impeller. The flow exiting the present return channel vane arrangement is more uniform. Further, since a lower number of return channel vanes 310 are provided in the present arrangement, the number of non-uniform sections per 360° exit will be reduced, thereby reducing the impact on the downstream impeller.

In one aspect, the return channel vane 310 has a sculpted and twisted body 340 shape. The body 340 has a bowed structure at the trailing edge 360 and a variable thickness along the longitudinal length of the body 340. The bowed structure modifies the end-wall loadings of the return channel vane 310 and impacts the span-wise pressure gradients that redistribute flow through the return channel. The thickness of the leading edge 350 and the trailing edge 360 is less than the thickness of the center of the body 340. The leading edge 350 of the body 340 is twisted about the longitudinal axis of the body 340 to induce bending in the return channel vane 310.

In the example shown in FIGS. 5(*a*)-5(*e*), the return channel vane 310 has an extended, sculpted, and twisted body 340 shape. The return channel vane 310 of FIG. 5(*c*) includes a body 340 with a bowed structure at the trailing edge 360 and a variable thickness along the longitudinal length L of the body 340. The thickness of the leading edge 350 and the trailing edge 360 is less than the thickness of the center of the body 340. The leading edge 350 of the body 340 is twisted about the longitudinal axis of the body 340 to induce bending in the return channel vane 310. The trailing edge 360 is sculpted to include a curvature relative to the longitudinal length L of the body 340. In one aspect, the twist angle β of the trailing edge 360 of each section 500, 505, 510, 515, 520 with respect to the meridional line 550 of the body 340 may be different. In one example, the twist angle β of the trailing edge 360 generally varies from +10° and −20° with respect to the meridional line 550 of the body 360. The return channel vane 310 of FIG. 5(*c*) also includes an extended leading edge 350 that, when attached to the return hub 330, extends past the edge of the return hub 330 and into the crossover portion of the return channel. Therefore, this example of the return channel vane 310 has a longer longitudinal length than the other examples of the return channel vane 310. In one aspect, the trailing edge 360 is positioned away from the downstream impeller stage. By positioning the trailing edge 360 away from the downstream impeller stage, the aeromechanical interactions with the downstream stage are alleviated. As shown in FIG. 10, by having more space between the trailing edge 360 of an upstream stage and the leading edge of the rotating impeller downstream, the stimulus that the flow exiting from the given stage that may be provided to the rotating downstream impeller, i.e., the coupling between them, will be reduced. In one aspect, the body 340 of the return channel vane 310 is adjusted based on the blade angle distribution based on the blade loading or the flow characteristics and manufacturing considerations.

Figure 6A:
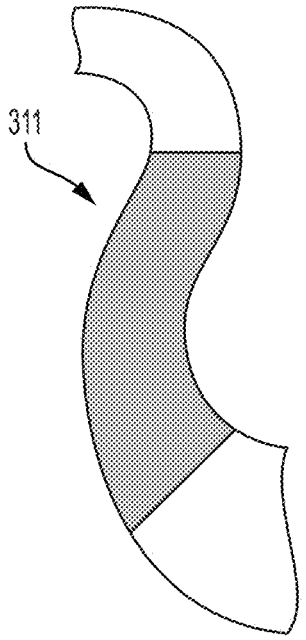
FIG. 6a PRIOR ART
FIG. 6(*a*) is a meridional view of a return channel vane according to the prior art.
Figure 6B:
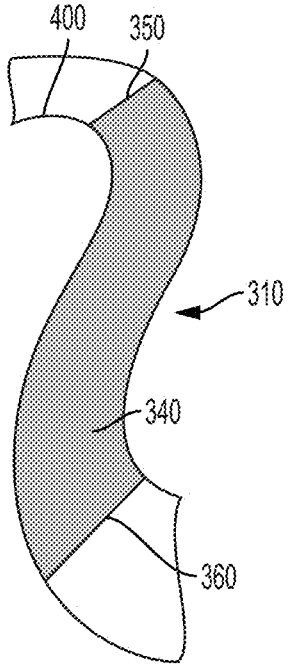
Figure 6C:
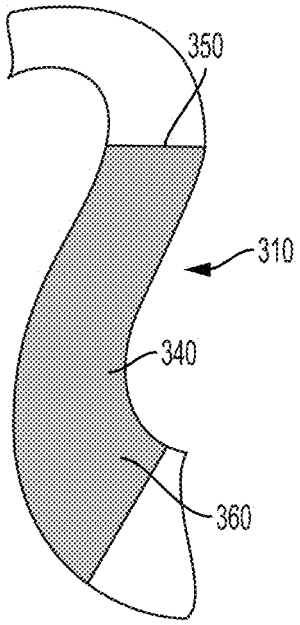

With reference to FIGS. 6(*a*)-6(*c*), each example of the return channel vanes 310 is shown in the return channel of the turbomachine 200. As shown in FIG. 6(*a*), the conventional return channel vanes 311 extend along the return channel along the length of the return hub 330. In one aspect shown in FIG. 6(*b*), however, the return channel vane 310 includes a leading edge 350 that extends into the crossover portion of the return channel, but does not extend to the apex 400 of the return hub 330. In one example, the crossover portion of the return channel is understood to be the portion of the return channel positioned between the impeller 240 and the return hub 330. By providing an extended leading edge 350 (which provides a longer return channel vane for a fixed trailing edge), a longer path length is provided for flow turning (the flow entering the return channel is radial and has a spiral form, which needs to be formed axially as much as possible—parallel to the axis of rotation for entry into the downstream stage). As shown in FIG. 6(*c*), the trailing edge 360 may be extended toward the next stage of the turbomachine 200.

Figure 7:
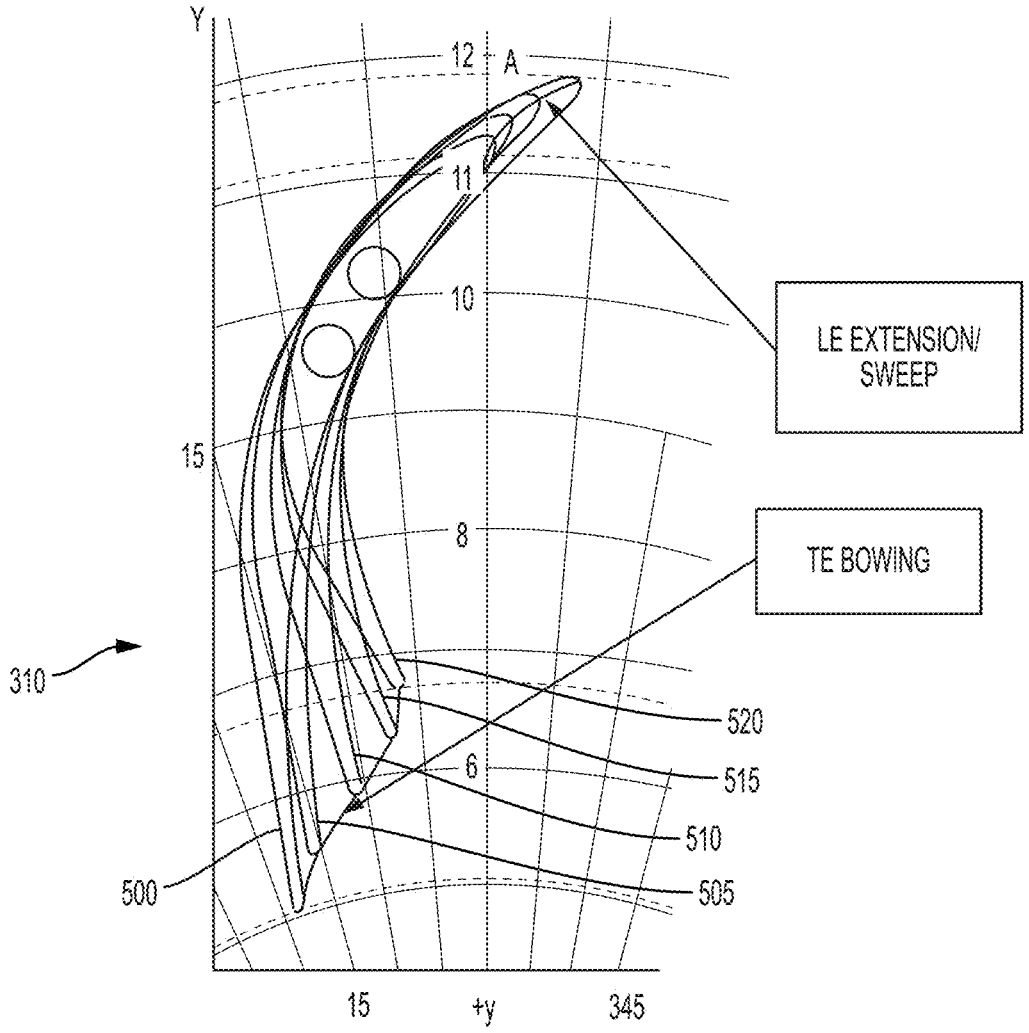
FIG. 7 is an illustration of the return channel vane of FIG. 5(*a*)
Figure 8:
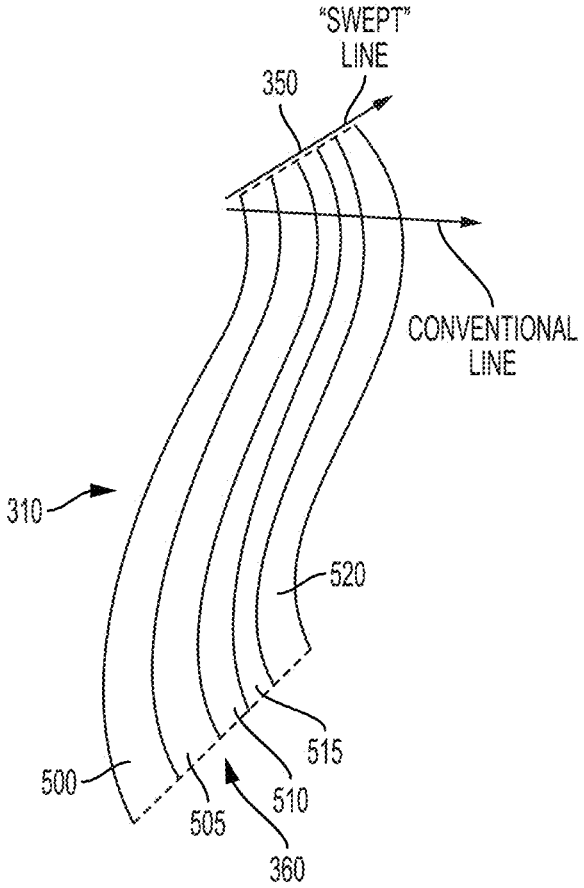
FIG. 8 is a schematic illustration of a return channel vane according to the present disclosure.
Figure 9:
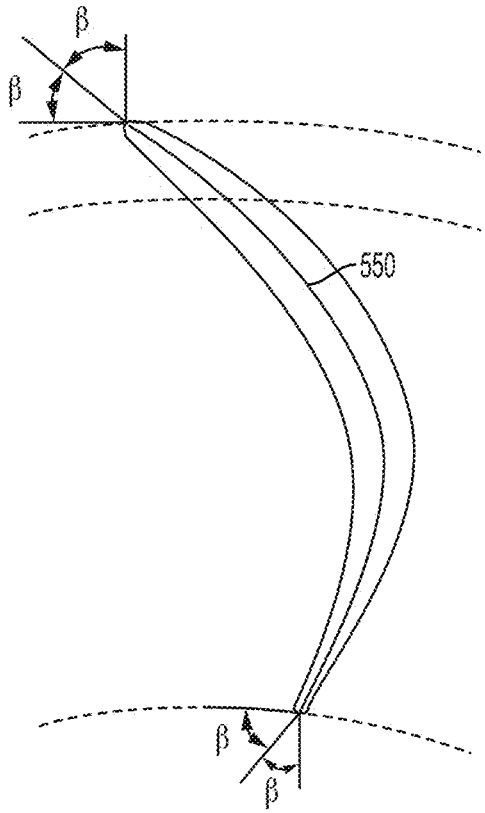
FIG. 9 is an illustration of the return channel vane of FIG. 5(*a*)

With reference to FIGS. 7 and 8, it is shown that each return channel vane 310 includes at least three sections 500, 505, 510, 515, 520. In one aspect, each return channel vane 310 is made of five sections 500, 505, 510, 515, 520. The sections 500, 505, 510, 515, 520 are formed together to form a monolithic structure for the return channel vane 310. By using five sections 500, 505, 510, 515, 520 to form the return channel vanes 310, an improved turning of the flow is achieved as soon as the flow approaches the return channel vane 310. With reference to FIG. 9, each section 500, 505, 510, 515, 520 of the return channel vane 310 has a different starting and trailing blade angle β. The starting and trailing angle β is measured relative to the meridional line 550 of each return channel vane 310. The different starting angles β assist in improving the blade loading in the entry section of the return channel. The leading edge 350 of each return channel vane 310 is tailored to achieve a good incidence, which requires a different starting angle β for each section 500, 505, 510, 515, 520, resulting in a "swept" leading edge 350. It is also contemplated that, due to the stacking of the sections 500, 505, 510, 515, 520, the trailing edge 360 may also be "swept". In contrast, conventional return channel vanes are flat or straight across from hub to shroud. The vane sections 500, 505, 510, 515, 520 may be offset circumferentially to obtain beneficial aerodynamic properties, such as recovery in static pressure. The multiple vane sections 500, 505, 510, 515, 520 are stacked (placed on top of one another) to satisfy the bulk (or average) stage exit swirl and its spanwise distribution, while maintaining or improving return channel loss characteristics. By arranging the vane sections 500, 505, 510, 515, 520 in this manner, a sculpted shape is achieved for the return channel vane 310, especially the trailing edge 360 of the return channel vane 310. As shown in FIGS. 7 and 9, each trailing edge of the vane sections 500, 505, 510, 515, 520 may have a different trailing angle β relative to the meridional line 550 of the return channel vane 310. In one aspect, the trailing edge of at least one vane section 500, 505, 510, 515, 520 may extend to one side of the meridional line 550 and the trailing edge of at least another vane section 500, 505, 510, 515, 520 may extend to an opposite side of the meridional line 550, which is also shown in FIGS. 5(*b*) and 7.

Figure 13:
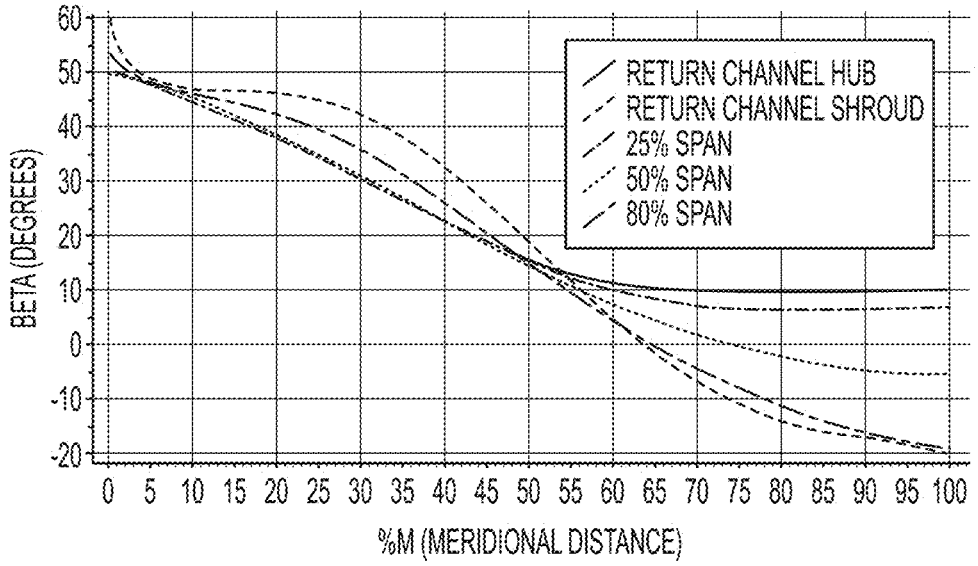
FIG. 13 is a graphical representation of the blade angle distribution of a return channel vane according to one aspect of the present disclosure.
Figure 14:
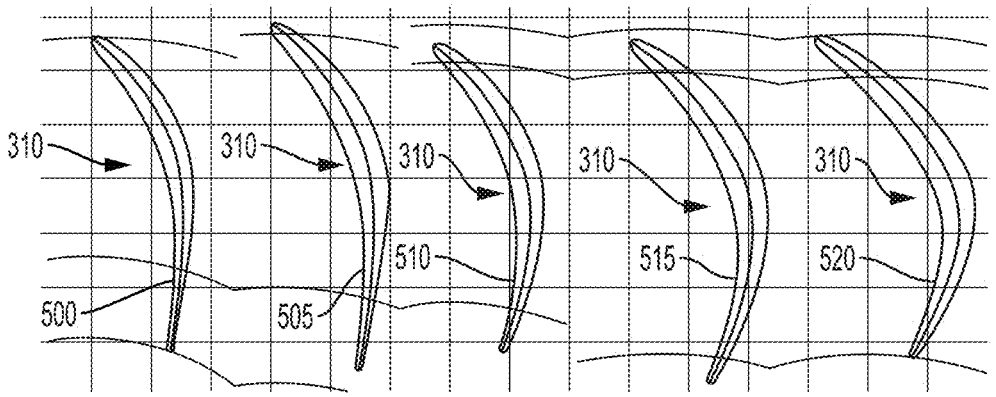
FIG. 14 is a schematic representation of the different sections that comprise the return channel vane of the present disclosure.

With reference to FIG. 13, the blade angle β distribution of the return channel vane 310 is described in further detail. The blade angle β is plotted against the percentage (%) meridional distance in which 0% corresponds to the leading edge 350 of the vane 310 and 100% corresponds to the trailing edge 360 of the vane 310. The blade angle β is measured from the meridional line. This graph shows how the blade angle β is distributed in the meridional projection of the return channel vane 310. At the leading edge 350 of the vane 310, the blade angle β varies mildly from hub to shroud, while at the trailing edge 360 of the vane 310 the variation is increased. The leading edge blade angle β (0% m) for each section is determined based on the incoming flow such that the leading edge 350 aligns well with the flow to provide improved incidence. The entrance region blade angle β (approx. 0-7% m) is arranged to provide a good flow turning from the leading edge 350 to the mid-region of the return channel. The mid-region blade angle β (approx. 7-50% m) is arranged to continue providing good flow turning such that the flow does not (but may) separate. As flow travels through the return channel, the static pressure increases. The blade angle β distribution (along with thickness) provides a varying channel area to achieve good pressure recovery. Further, due to the need to place an anchoring bolt through this region, the freedom to arrange the blade angle β distribution is limited. The blade angle β distribution of the transition area to the trailing edge 360 (approx. 50-80% m) provide good flow turning. The blade angle β distribution for the trailing edge 360 (100% m) is arranged to impact the spanwise distribution of swirl exiting the stage. As shown in FIG. 14, each section 500, 505, 510, 515, 520 of the return channel vane 310 includes a varying shape and thickness. The arrangement of the blade angle β corresponds simultaneously with the thickness distribution of the return channel vane 310 since together they provide variable area passage that smoothly turns the flow to axial, while reducing the swirl as well as increasing the static pressure of the flow. The kinetic energy of the flow is converted into static pressure recovery, while the total pressure is always reduced. The total pressure, which includes dynamic pressure and static pressure, loses the dynamic component to gain an additional static component.

Figure 16:
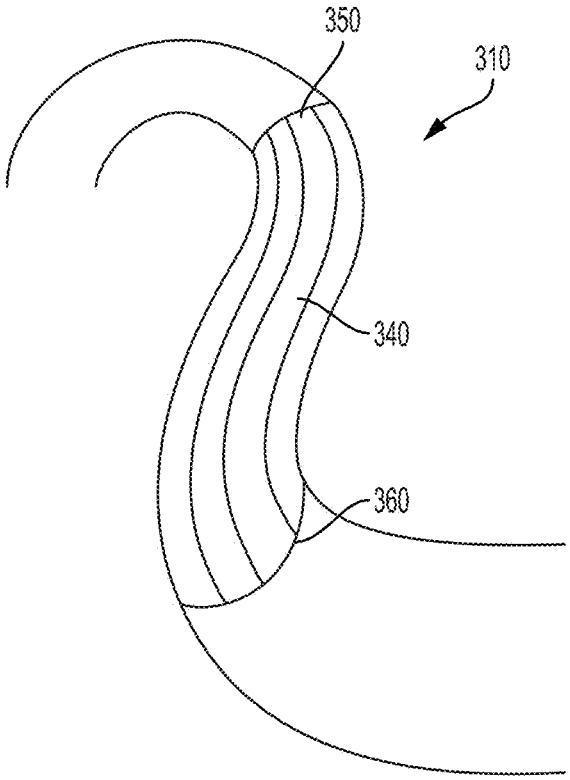
FIG. 16 is a meridional view of a return channel vane according to another example of the present disclosure.
Figure 17:
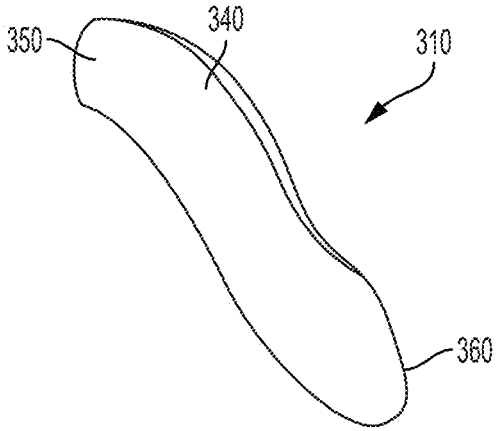
FIG. 17 is a perspective view of the return channel vane of FIG. 16.
Figure 18:
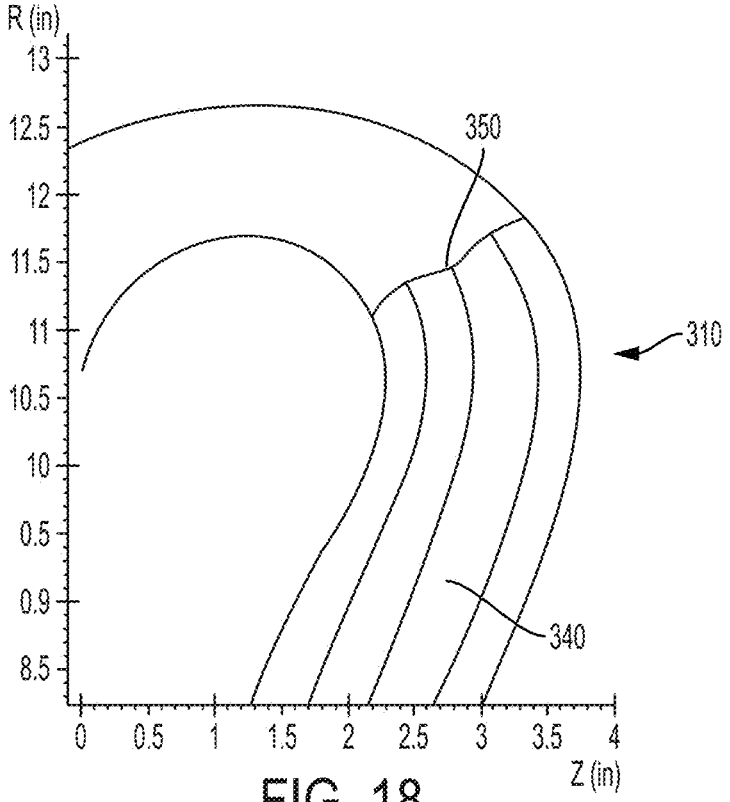
FIG. 18 is a meridional view of a leading edge of a return channel vane according to another example of the present disclosure.
Figure 19:
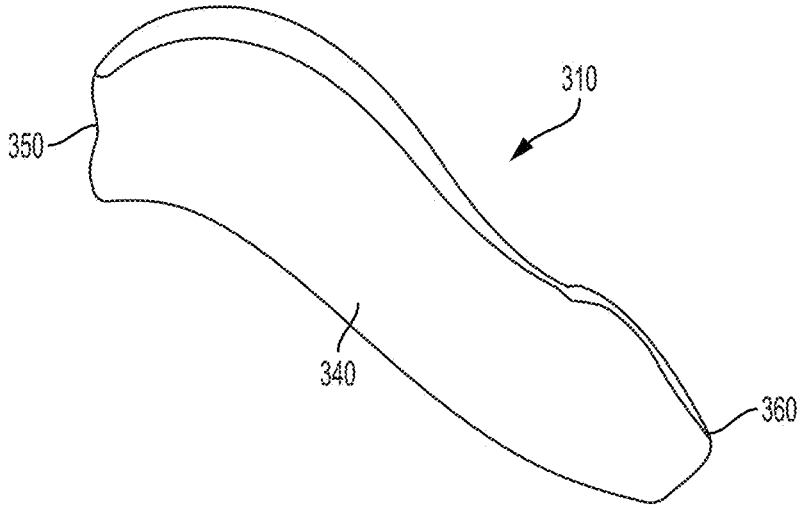
FIG. 19 is a perspective view of the return channel vane of FIG. 18.
Figure 20:
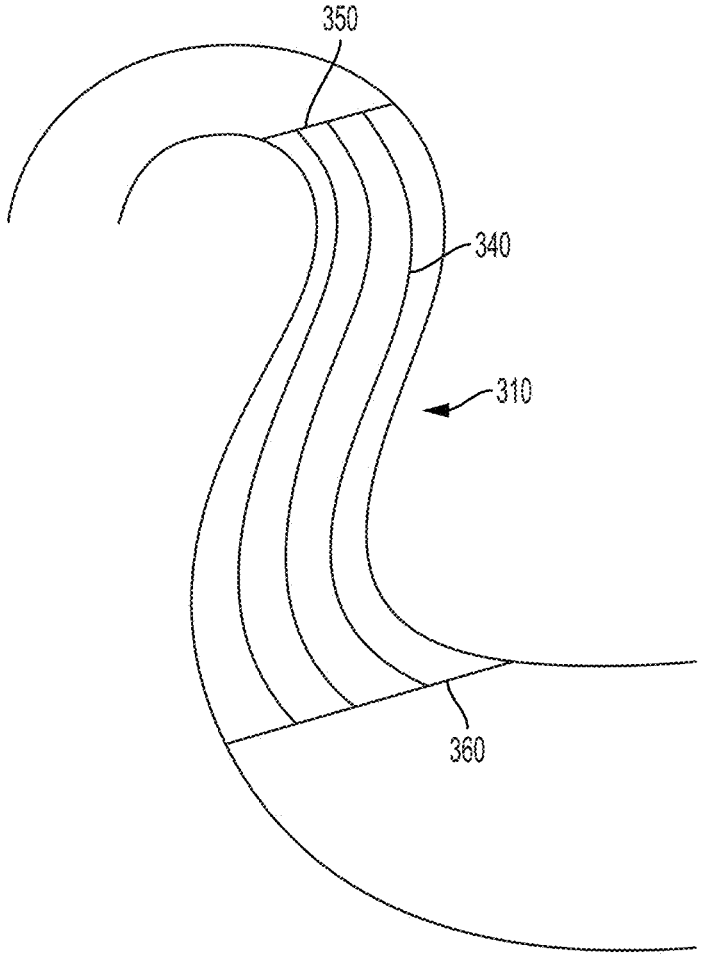
FIG. 20 is a meridional view of a return channel vane according to another example of the present disclosure.

With reference to FIGS. 16 and 17, in another example of the return channel vane 310, at least one of the leading edge 350 and the trailing edge 360 includes middle sections that extend further than the outer sections of the leading 350 or trailing edge 360. In this example, the middle portion of the leading 350 or trailing edge 360 extend further upstream or downstream, respectively, than the outer edges of the leading 350 or trailing edge 360. With reference to FIGS. 18 and 19, according to another example of the return channel vane 310, the leading edge 350 includes at least one section with nominal extension upstream. In this example, the outer edges of the leading edge 350 extend upstream, while a middle portion of the leading edge 350 does not. With reference to FIG. 20, according to another example of the present disclosure, the lowermost section of the leading edge 350 of the return channel vane 310 extends away from the body 340 relative to the longitudinal axis of the body 340. The uppermost section of the trailing edge 360 may also extend away from the body 340 relative to the longitudinal axis of the body 340.

A method of developing and designing the present return channel vanes 310 is now described. Initially, a base compressor computational fluid dynamics (CFD) model is initiated to conduct flow diagnosis of the compressor, i.e., exit swirl distribution, average exit swirl distribution, total pressure loss characteristics, and blade loading, among other factors. An operator then assesses whether any undesirable flow features can be remedied by using the concepts of the return channel vane 310 of the present disclosure, i.e., extending the leading edge, adding more sections to the vanes, and adjusting the angles of the leading and trailing edges. In the event these concepts appear to be applicable, the baseline return channel vanes are converted to the return channel vanes 310 of the present disclosure. A CFD analysis is then again conducted to determine the flow diagnosis of the compressor. This CFD analysis and modification of the return channel vane is repeated until the desired flow diagnosis of the compressor is achieved. The return channel vane 310 can be modified to include an extended leading edge 350 that extends into the crossover of the return channel, where the swirl is generally low. The lean of the return channel vane 310 should also be kept in mind. The lean is the angle between the vane surface and the hub surface. The leading edge 350 could become more curved or swept as vane sections are added from the hub to the shroud. The body 340 of the return channel vane 310 can be adjusted based on the observed blade loading (or how well the vane turns the flow) of the return channel vane 310 through CFD. This adjustment can be restricted, however, due to the need to drill holes for anchoring bolts into the return channel vane 310.

While several examples of the turbomachine 200 and return channel vanes 310 are shown in the accompanying figures and described in detail hereinabove, other examples will be apparent to, and readily made by, those skilled in the art without departing from the scope and spirit of the disclosure. Accordingly, the foregoing description is intended to be illustrative rather than restrictive. The invention described hereinabove is defined by the appended claims and all changes to the invention that fall within the meaning and range of equivalency of the claims are to be embraced within their scope.

The invention claimed is:

1. A return channel vane arrangement for a multi-stage, centrifugal-flow turbomachine, comprising:

at least one return channel vane comprising a body including a leading edge and a trailing edge provided on an opposite end of the body, wherein the leading edge is shaped according to an impinging flow resulting in a varying inlet blade angle;

wherein the trailing edge is shaped to provide uniform distribution of swirl through a variable trailing edge blade angle resulting in a sculpted or bowed trailing edge;

wherein the at least one return channel vane is comprised of at least three sections stacked on top of one another when viewed along a longitudinal axis of the at least one return channel vane, in which each section of the at least one return channel vane has a different starting and trailing blade angle relative to the meridional line of the body, and wherein the leading edge of the body is configured to be positioned within a crossover portion of the return channel hub of the multi-stage, centrifugal-flow turbomachine, in which the crossover portion is a portion of the multi-stage, centrifugal-flow turbomachine provided between an impeller and a return hub.

2. The return channel vane arrangement as claimed in claim 1, wherein the trailing edge of one of the at least three sections is angled to one side of the meridional line of the body and the trailing edge of the other of the at least three sections is angled to an opposing side of the meridional line of the body.

3. The return channel vane arrangement as claimed in claim 1, wherein the trailing blade angles range between +10° and −20° relative to the meridional line of the body.

4. The return channel vane arrangement as claimed in claim 1, wherein a portion of a leading edge of the at least one return channel vane extends further from the body than leading edges of the remaining sections of the at least one return channel vane.

5. The return channel vane arrangement as claimed in claim 1, wherein a portion of a trailing edge of the at least one return channel vane extends further from the body than trailing edges of the remaining sections of the at least one return channel vane.

6. The return channel vane arrangement as claimed in claim 1, wherein each section has a curvature relative to a longitudinal axis of the at least one return channel vane, and wherein the curvature of at least one section is different from the curvature of the remaining sections.

7. The return channel vane arrangement as claimed in claim 1, wherein the body of the at least one return channel vane is curved relative to a longitudinal axis of the at least one return channel vane.

8. The return channel vane arrangement as claimed in claim 1, wherein the at least one return channel vane is configured to provide a reduced swirl angle that varies from −5° to +5°.

9. The return channel vane arrangement as claimed in claim 1, wherein the at least one return channel vane comprises twelve return channel vanes.

10. A multi-stage, centrifugal-flow turbomachine, comprising:

a housing having an inlet end opposite an outlet end along a longitudinal axis of the housing;

a shaft assembly provided within the housing, the shaft assembly extending from the inlet end to the outlet end;

a rotor having at least one impeller extending radially outward from the shaft assembly; and a return channel vane hub extending radially outward from the shaft assembly, the return channel vane hub includes a return channel vane arrangement comprising at least one return channel vane extending therefrom, the at least one return channel vane comprising a body having a leading edge and a trailing edge, the leading edge is twisted and extended past an outer edge of the return channel vane hub, and the trailing edge is sculpted, wherein the at least one return channel vane is comprised of at least three sections stacked on top of one another when viewed along a longitudinal axis of the at least one return channel vane, in which each section of the at least one return channel vane has a different starting and trailing blade angle relative to the meridional line of the body, and wherein the leading edge of the body is configured to be positioned within a crossover portion of a return channel hub of the multi-stage, centrifugal-flow turbomachine, in which the crossover portion is a portion of the multi-stage, centrifugal-flow turbomachine provided between an impeller and a return hub.

11. The multi-stage, centrifugal-flow turbomachine as claimed in claim 10, wherein the trailing edge of one of the at least three sections is angled to one side of the meridional line of the body and the trailing edge of the other of the at least three sections is angled to an opposing side of the meridional line of the body.

12. The multi-stage, centrifugal-flow turbomachine as claimed in claim 10, wherein the blade angles range between +10° and −20° relative to the meridional line of the body.

13. The multi-stage, centrifugal-flow turbomachine as claimed in claim 10, wherein a leading edge of at least one section of the at least one return channel vane extends further from the body than leading edges of the remaining sections of the at least one return channel vane.

14. The multi-stage, centrifugal-flow turbomachine as claimed in claim 10, wherein a trailing edge of at least one section of the at least one return channel vane extends further from the body than trailing edges of the remaining sections of the at least one return channel vane.

15. The multi-stage, centrifugal-flow turbomachine as claimed in claim 10, wherein each section has a curvature relative to a longitudinal axis of the at least one return channel vane, and wherein the curvature of at least one section is different from the curvature of the remaining sections.

16. The multi-stage, centrifugal-flow turbomachine as claimed in claim 10, wherein the body of the at least one return channel vane is curved relative to a longitudinal axis of the at least one return channel vane.

17. The multi-stage, centrifugal-flow turbomachine as claimed in claim 10, wherein the at least one return channel vane is configured to provide a reduced swirl angle that varies from −5° to +5°.

18. The multi-stage, centrifugal-flow turbomachine as claimed in claim 10, wherein the at least one return channel vane comprises twelve return channel vanes.

* * * * *